US011957177B2

(12) United States Patent
Yamada et al.

(10) Patent No.: US 11,957,177 B2
(45) Date of Patent: Apr. 16, 2024

(54) SMOKING SYSTEM HAVING CONSUMABLE WITH A HOLDER

(71) Applicant: Japan Tobacco Inc., Tokyo (JP)

(72) Inventors: Manabu Yamada, Tokyo (JP); Yasunobu Inoue, Tokyo (JP); Tateki Sumii, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 18/099,624

(22) Filed: Jan. 20, 2023

(65) Prior Publication Data

US 2023/0148671 A1 May 18, 2023

Related U.S. Application Data

(60) Division of application No. 17/863,961, filed on Jul. 13, 2022, which is a continuation of application No. PCT/JP2020/046206, filed on Dec. 11, 2020.

(30) Foreign Application Priority Data

Feb. 27, 2020 (WO) ..... PCT/JP2020/007940

(51) Int. Cl.
*A24F 13/00* (2006.01)
*A24F 40/20* (2020.01)
*A24F 40/465* (2020.01)

(52) U.S. Cl.
CPC ..... *A24F 40/465* (2020.01); *A24F 40/20* (2020.01)

(58) Field of Classification Search
CPC ..... A24F 47/00
(Continued)

(56) References Cited

U.S. PATENT DOCUMENTS 5,954,979 A 9/1999 Counts et al.
9,532,603 B2 1/2017 Plojoux et al.
(Continued)

FOREIGN PATENT DOCUMENTS

CN 103503557 A 1/2014
CN 207236096 U 4/2018
(Continued)

OTHER PUBLICATIONS

International Search Report (PCT/ISA/210) issued in PCT/JP2020/046206, dated Feb. 16, 2021.
(Continued)

*Primary Examiner* — Phuong K Dinh
(74) *Attorney, Agent, or Firm* — Birch, Stewart, Kolasch & Birch, LLP

(57) ABSTRACT

A smoking system includes a consumable containing a smokable substance and a device that includes a chamber receiving the consumable and heats and atomizes the smokable substance of the consumable received in the chamber. The chamber includes an opening through which the consumable is inserted and a holding unit that holds the consumable. The holding unit includes a first pressing unit which presses a part of the consumable. The consumable includes a first portion having a first hardness and a second portion having a second hardness, in which the second portion is a different portion from the first portion in the insertion direction of the consumable. When the consumable is positioned at the desired position in the chamber, the consumable is positioned such that at least a part of the first portion is pressed against the first pressing unit, while at the same time, at least a part of the second portion is pressed against the first pressing unit.

18 Claims, 24 Drawing Sheets

(58) Field of Classification Search
USPC ..... 131/328–329
See application file for complete search history.

(56) References Cited

U.S. PATENT DOCUMENTS

| | | | |
|---|---|---|---|
| 2013/0287378 | A1 | 10/2013 | Kida et al. |
| 2014/0353185 | A1 | 12/2014 | Liu |
| 2015/0136154 | A1 | 5/2015 | Mitrev et al. |
| 2016/0235122 | A1 | 8/2016 | Krietzman |
| 2016/0360794 | A1 | 12/2016 | Li et al. |
| 2018/0042299 | A1 | 2/2018 | Han et al. |
| 2018/0263286 | A1 | 9/2018 | Reevell |
| 2019/0150504 | A1 | 5/2019 | Liu et al. |
| 2019/0208816 | A1 | 7/2019 | Thorsen |
| 2019/0230989 | A1 | 8/2019 | Fursa et al. |
| 2020/0037663 | A1 | 2/2020 | Chau et al. |
| 2020/0323270 | A1* | 10/2020 | Chen ..... A24F 40/40 |
| 2021/0045448 | A1 | 2/2021 | Yamada et al. |

FOREIGN PATENT DOCUMENTS

| | | | |
|---|---|---|---|
| CN | 108451028 | A | 8/2018 |
| CN | 109195463 | A | 1/2019 |
| CN | WO2019/140749 | * | 7/2019 |
| EP | 3 610 741 | A1 | 2/2020 |
| GB | 2534215 | A | 7/2016 |
| JP | 2001-521123 | A | 11/2001 |
| JP | 2005-221120 | A | 8/2005 |
| JP | 2007-259864 | A | 10/2007 |
| JP | WO2013/140845 | A1 | 9/2013 |
| JP | 2014-525251 | A | 9/2014 |
| JP | 5963375 | B2 | 8/2016 |
| JP | 2018-500016 | A | 1/2018 |
| JP | 2018-509145 | A | 4/2018 |
| JP | 2019-513388 | A | 5/2019 |
| JP | 2019-521656 | A | 8/2019 |
| JP | 2019-526233 | A | 9/2019 |
| JP | 2020-18285 | A | 2/2020 |
| WO | WO 2013/034460 | A1 | 3/2013 |
| WO | WO 2016/092261 | A1 | 6/2016 |
| WO | WO 2016/207407 | A1 | 12/2016 |
| WO | WO 2018/019543 | A1 | 2/2018 |
| WO | WO 2018/189195 | A1 | 10/2018 |
| WO | WO 2018/190606 | A1 | 10/2018 |
| WO | WO 2019/140749 | A1 | 7/2019 |
| WO | WO 2019/208536 | A1 | 10/2019 |
| WO | WO 2020/074602 | A1 | 4/2020 |
| WO | WO 2021/044023 | A1 | 3/2021 |

OTHER PUBLICATIONS

International Search Report for International Application No. PCT/JP2020/007940, dated May 19, 2020.

International Search Report for International Application No. PCT/JP2020/046207, dated Feb. 16, 2021.

International Search Report for International Application No. PCT/JP2020/046209, dated Feb. 22, 2021.

International Search Report for International Application No. PCT/JP2021/006563, dated May 18, 2021.

Taiwanese Office Action and Search Report for Taiwanese Application No. 109120402, dated Jul. 26, 2022, with an English translation.

Taiwanese Office Action and Search Report for Taiwanese Application No. 109143892, dated Jul. 26, 2022, with an English translation.

Taiwanese Office Action and Search Report for Taiwanese Application No. 109143894, dated Apr. 22, 2022, with an English translation.

Japanese Notice of Reasons for Refusal for Japanese Application No. 2022-502695, dated Aug. 9, 2023, with an English translation.

Japanese Notice of Reasons for Refusal for Japanese Application No. 2022-503107, dated Aug. 9, 2023, with an English translation.

Extended European Search Report for European Application No. 20921741.3, dated May 30, 2023.

Extended European Search Report for European Application No. 23155555.8, dated May 30, 2023.

Extended European Search Report for European Application No. 20921245.5, dated Oct. 24, 2023.

Extended European Search Report for European Application No. 21760457.8, dated Mar. 1, 2024.

* cited by examiner

SMOKING SYSTEM HAVING CONSUMABLE WITH A HOLDER

CROSS-REFERENCE TO RELATED APPLICATION

This application is a Divisional application of U.S. application Ser. No. 17/863,961, filed Jul. 13, 2022, which is a Continuation application of International Application No. PCT/JP2020/046206, filed on Dec. 11, 2020. This application is based upon and claims benefit of priority from International Application No. PCT/JP2020/007940 filed on Feb. 27, 2020 and International Application No. PCT/JP2020/046206 filed on Dec. 11, 2020. The entire contents of each of the above-identified applications are incorporated herein by reference.

TECHNICAL FIELD

The present invention relates to a device.

BACKGROUND ART

In the related art, a flavor inhaler for inhaling flavors and the like without combusting a material is known. The flavor inhaler includes, for example, a chamber that houses a flavor-producing article and a heater that heats the flavor-producing article housed in the chamber (for example, refer to PTL 1-3).

CITATION LIST

Patent Literature

PTL 1: Japanese Translation of PCT International Application Publication No. 2001-521123

PTL 2: Japanese Patent No. 5963375

PTL 3: International Publication No. WO 2016/207407

SUMMARY OF INVENTION

According to one aspect of the present invention, a smoking system including a consumable containing a smokable substance and a device that heats and atomizes the smokable substance is provided. The device includes a chamber that receives the consumable and a heating unit that heats the consumable received into the chamber. The chamber includes an opening through which the consumable is inserted and a holding unit that holds the consumable. The holding unit includes a pressing unit, which presses a part of the consumable, and a non-pressing unit. The pressing unit and the non-pressing unit each have an inner surface and an outer surface. The heating unit is disposed on the outer surface of the pressing unit. The inner surface of the pressing unit may also be referred to as a pressing surface that presses the consumable, and the inner surface of the non-pressing unit may also be referred to as a non-pressing surface that does not press the consumable.

DESCRIPTION OF EMBODIMENTS

First Embodiment

Figure 1:
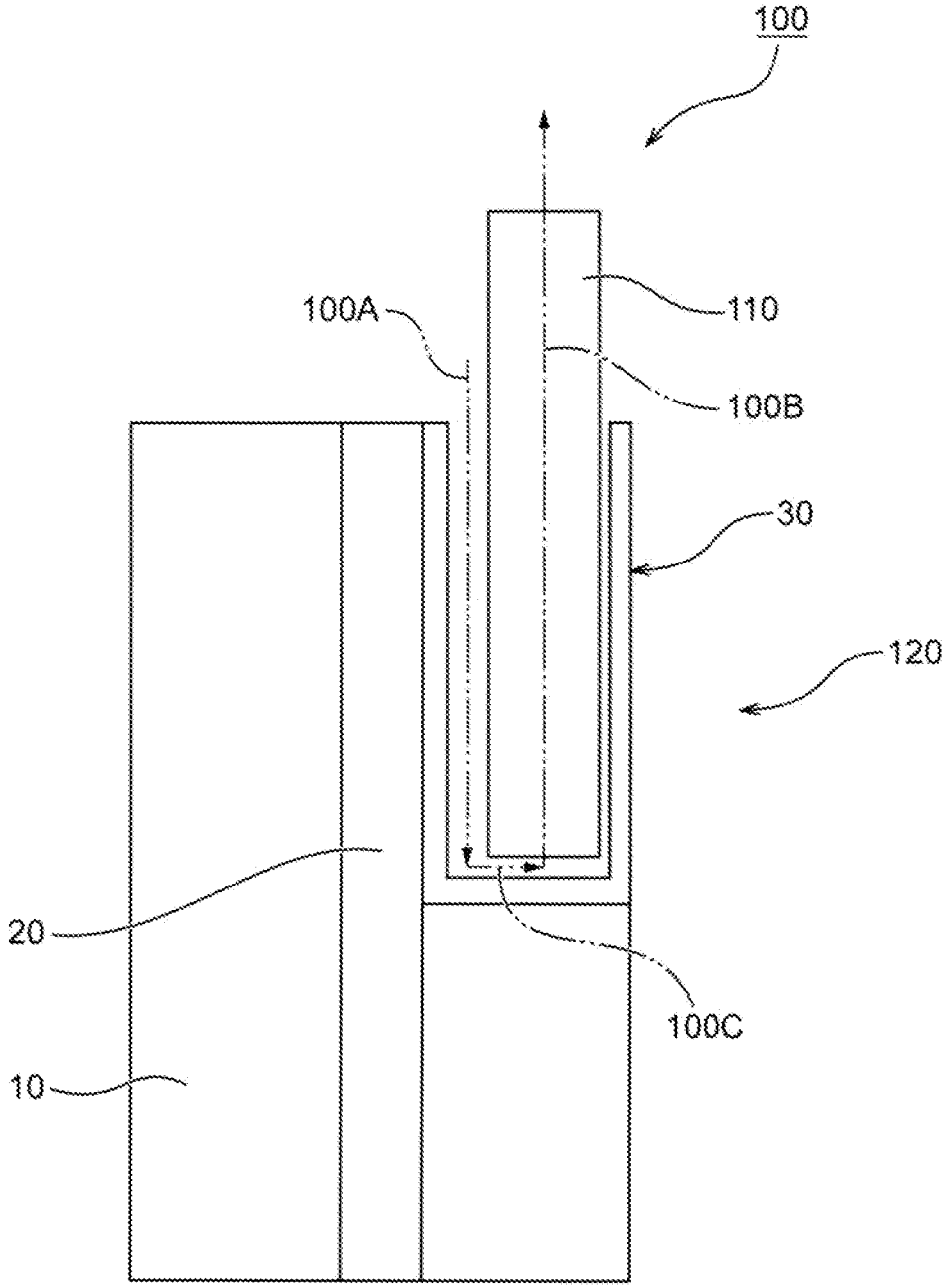
FIG. 1 is a diagram illustrating a smoking system according to a first embodiment.

Hereinafter, embodiments of the present invention will be described with reference to the drawings. In the drawings described hereinafter, the same or corresponding structural elements are denoted with the same signs, and duplicate description is omitted. FIG. 1 is a diagram illustrating a smoking system 100 according to a first embodiment. As illustrated in FIG. 1, the smoking system 100 includes a consumable 110 including a smokable substance, and a device 120 that heats and atomizes the smokable substance. The first embodiment illustrates the example of a case where the user puts the consumable 110 in his or her mouth and performs a puff action. The air inhaled by the user is guided into the user's mouth through an air flow 100A, an air flow 100C, and an air flow 100B in the above order, for example.

The consumable 110 is a base material including a smokable substance such as tobacco that can be smoked to emit a flavor, and has a pillar shape extending in the longitudinal direction for example. The consumable 110 may be a tobacco stick, for example.

The device 120 includes a battery 10, a control circuit 20, and a heater assembly 30. The battery 10 stores power to be used by the device 120. For example, the battery 10 is a lithium-ion battery. The battery 10 may also be chargeable from an external power source.

The control circuit 20 includes a CPU, a memory, and the like, and controls operations by the device 120. For example, the control circuit 20 starts heating the consumable 110 in response to a user operation performed on an input device such as a push-button, a slider, or a switch not illustrated, and ends the heating of the consumable 110 after a certain time has elapsed. The control circuit 20 may also end the heating of the consumable 110 when the number of puff actions by the user exceeds a certain value, even if the certain time has not yet elapsed since the heating of the consumable 110 was started. For example, puff actions are detected by a sensor not illustrated.

Alternatively, the control circuit 20 may start heating the consumable 110 in response to the start of a puff action, and end the heating of the consumable 110 in response to the end of a puff action. The control circuit 20 may also end the heating of the consumable 110 if a certain time has elapsed since the start of the puff action, even if the puff action has not yet ended. In this embodiment, the control circuit 20 is disposed between the battery 10 and the heater assembly 30, inhibiting the transfer of heat from the heater assembly 30 to the battery 10.

Figure 2:
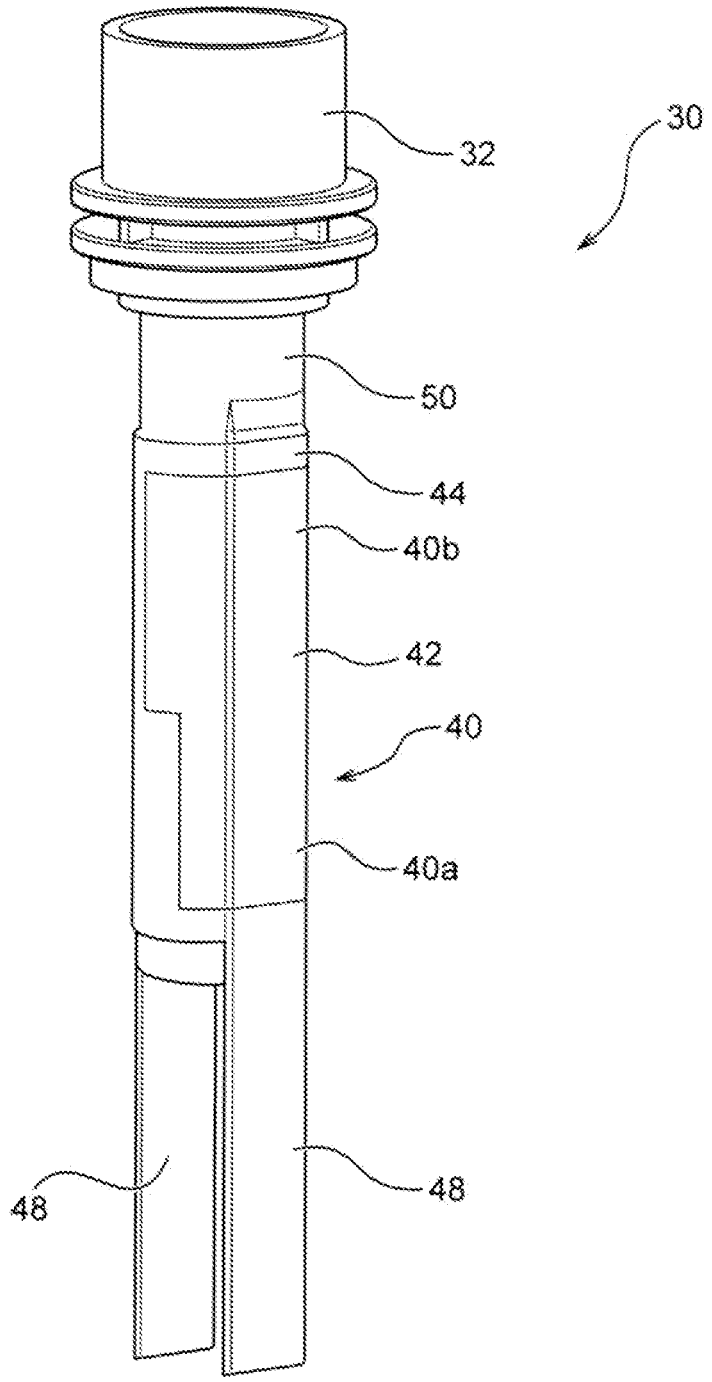
FIG. 2 illustrates a perspective view of the heater assembly illustrated in FIG. 1.

The heater assembly 30 is an assembly that heats the consumable 110. FIG. 2 illustrates a perspective view of the heater assembly 30 illustrated in FIG. 1. As illustrated in FIG. 2, the heater assembly 30 includes a top cap 32, a heating unit 40, and a chamber 50. The chamber 50 is configured to receive the consumable 110. The heating unit 40 is configured to heat the consumable 110 received into the chamber 50. The top cap 32 functions as a guide when inserting the consumable 110 into the chamber 50, and may also be configured to secure the chamber 50 to the device 120.

Figure 3:
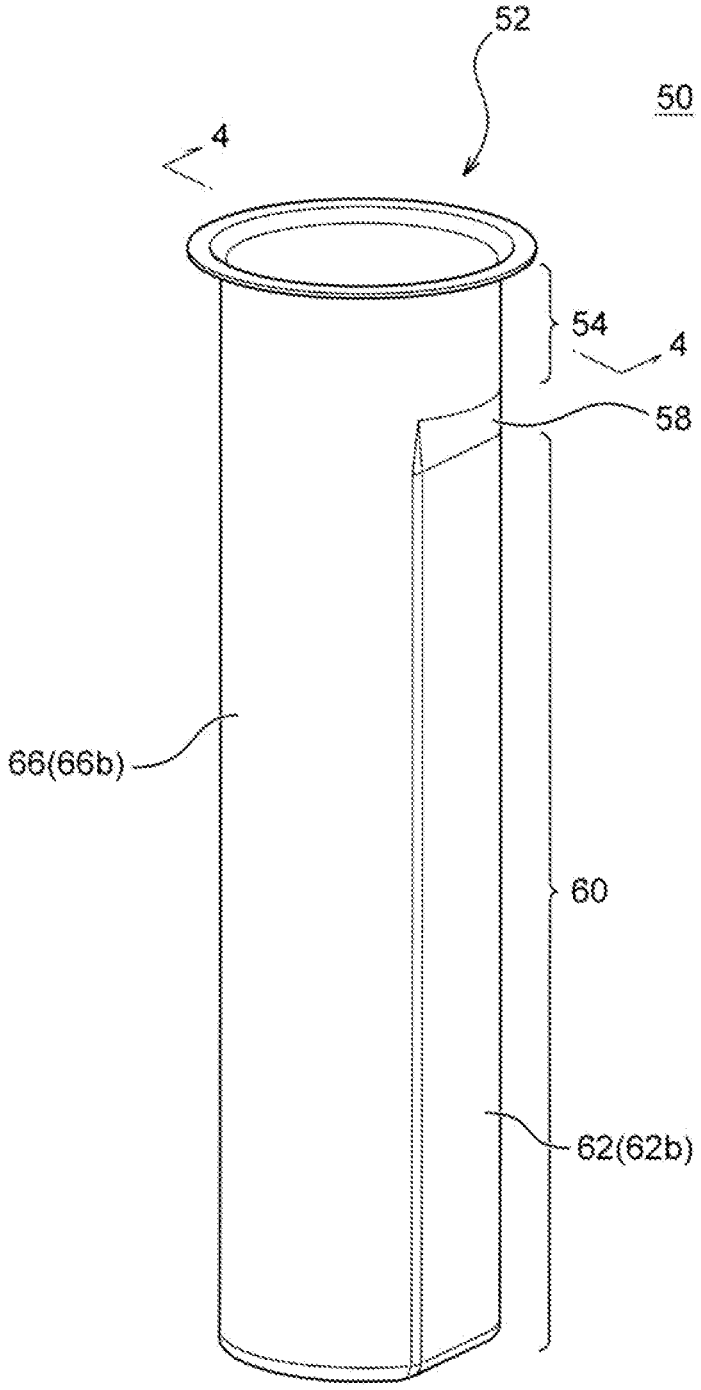
FIG. 3 illustrates a perspective view of a chamber.
Figure 4:
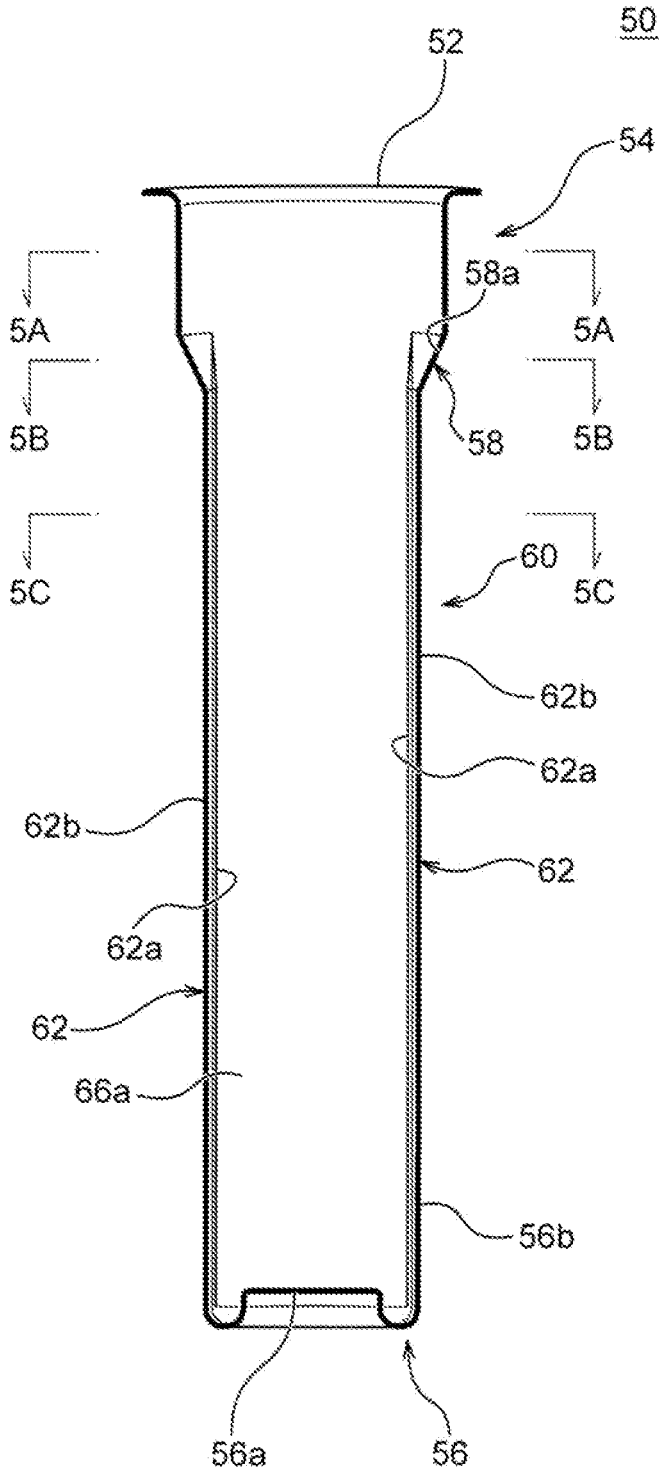
FIG. 4 illustrates a cross section of the chamber taken along the arrow 4-4 illustrated in FIG. 3.
Figure 5A:
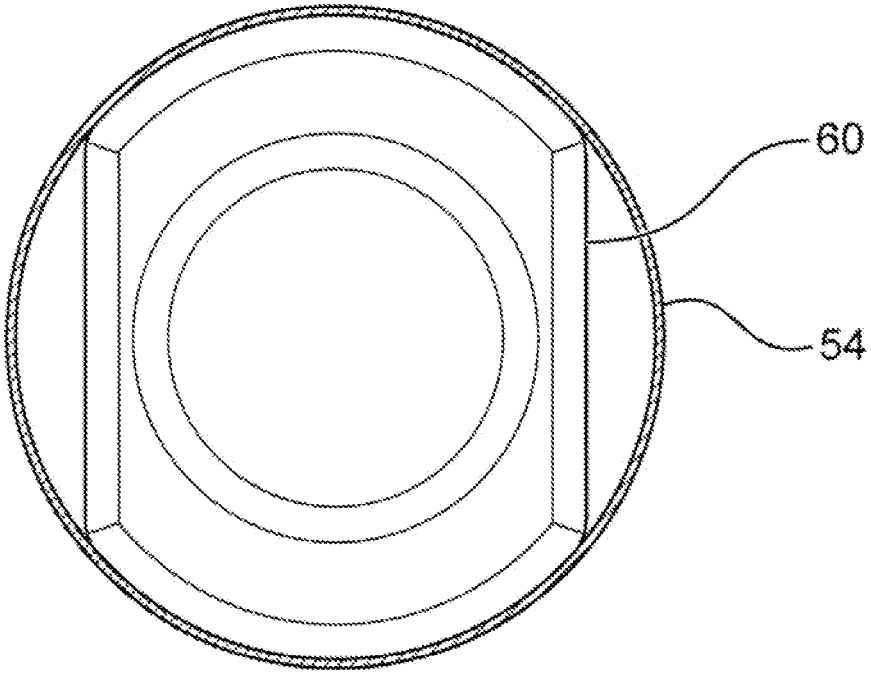
FIG. 5A illustrates a cross section of the chamber taken along the arrow 5A-5A illustrated in FIG. 4.
Figure 5B:
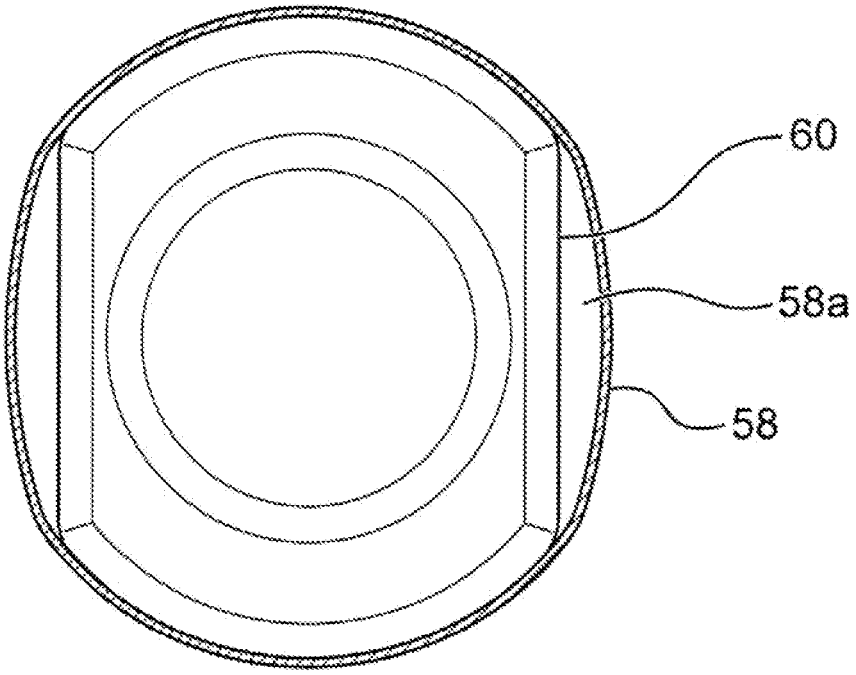
FIG. 5B illustrates a cross section of the chamber taken along the arrow 5B-5B illustrated in FIG. 4.
Figure 5C:
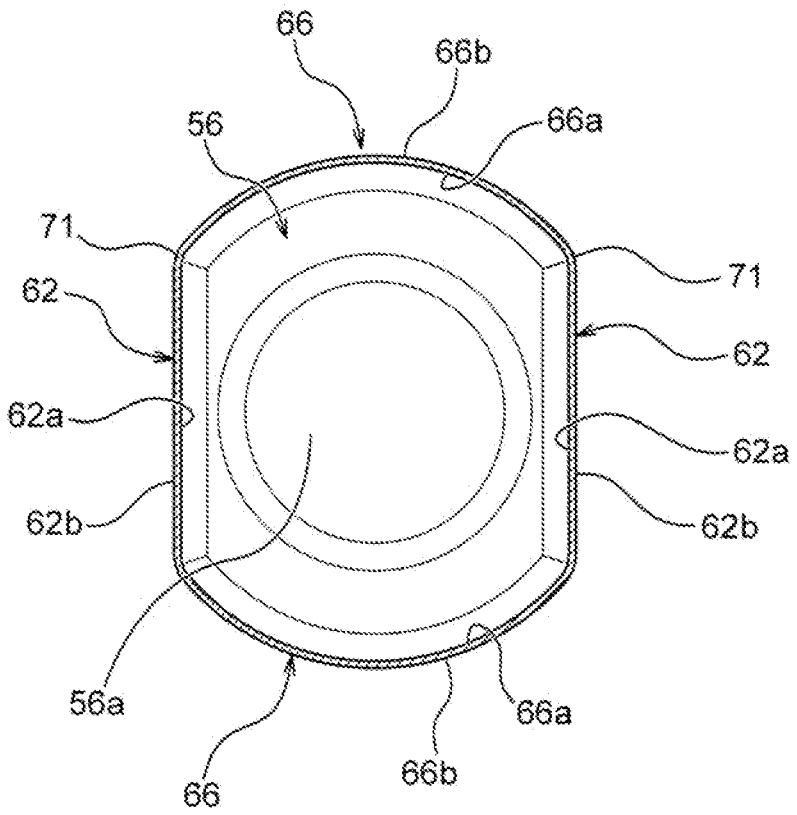
FIG. 5C illustrates a cross section of the chamber taken along the arrow 5C-5C illustrated in FIG. 4.

FIG. 3 illustrates a perspective view of the chamber 50. FIG. 4 illustrates a cross section of the chamber 50 taken along the arrow 4-4 illustrated in FIG. 3. FIG. 5A illustrates a cross section of the chamber 50 taken along the arrow 5A-5A illustrated in FIG. 4. FIG. 5B illustrates a cross section of the chamber 50 taken along the arrow 5B-5B illustrated in FIG. 4. FIG. 5C illustrates a cross section of the chamber 50 taken along the arrow 5C-5C illustrated in FIG. 4. As illustrated in FIGS. 3 and 4, the chamber 50 may be a bottomed cylindrical member including an opening 52 into which the consumable 110 is inserted and a holding unit 60 that holds the consumable 110. Note that the chamber 50 may also be a cylindrical object with no bottom. The chamber may be formed using a metal with high thermal conductivity, such as stainless steel for example. This configuration makes effective heating from the chamber 50 to the consumable 110 possible.

As illustrated in FIGS. 4 and 5C, the holding unit 60 includes a pressing unit 62, which presses a part of the consumable 110, and a non-pressing unit 66. The pressing unit 62 has an inner surface 62*a* and an outer surface 62*b*. The non-pressing unit 66 has an inner surface 66*a* and an outer surface 66*b*. As illustrated in FIG. 2, the heating unit 40 is disposed on the outer surface 62*b* of the pressing unit 62. The heating unit 40 preferably is disposed on the outer surface 62*b* of the pressing unit 62 with no gap. Note that the heating unit 40 may also include an adhesive layer. In this case, the heating unit 40 including the adhesive layer is preferably disposed with no gap to the outer surface 62*b* of the pressing unit 62.

The opening 52 in the chamber 50 preferably can receive the consumable 110 without pressing. The shape of the opening 52 in the chamber 50 in the plane orthogonal to the longitudinal direction of the chamber 50, or in other words, the direction in which the consumable 110 is inserted into the chamber 50 or the direction in which the sides of the chamber 50 extend overall, may be a polygonal shape or an elliptical shape, but preferably is circular.

As illustrated in FIGS. 3 and 5C, the outer surface 62*b* of the pressing unit 62 is a flat surface. Since the outer surface 62*b* of the pressing unit 62 is a flat surface, when band-shaped electrodes 48 are connected to the heating unit 40 disposed on the outer surface 62*b* of the pressing unit 62, bending of the band-shaped electrodes 48 can be suppressed. As a result, it is easy to lay out the electrodes 48 inside the device 120. In addition, compared to the case where the outer surface 62*b* of the pressing unit 62 is a curved or uneven surface, the heating unit 40 can be positioned accurately and disposed easily without a gap to the outer surface 62*b* of the pressing unit 62. As illustrated in FIGS. 4 and 5C, the inner surface 62*a* of the pressing unit 62 is a flat surface. Also, as illustrated in FIGS. 4 and 5C, the thickness of the pressing unit 62 is uniform.

As illustrated in FIGS. 3, 4, and 5C, in the first embodiment, the chamber 50 includes two or more pressing units 62 in the circumferential direction of the chamber 50. As illustrated in FIGS. 4 and 5C, the two pressing units 62 of the holding unit 60 face each other. At least a portion of the distance between the inner surfaces 62*a* of the two pressing units 62 is preferably shorter than the width of the consumable 110 inserted into the chamber 50 at the location disposed between the pressing units 62. As illustrated in the drawings, the inner surfaces 62*a* of the pressing units 62 are flat surfaces.

As illustrated in FIG. 5C, the inner surfaces 62*a* of the pressing units 62 have pairs of flat pressing surfaces having a planar shape and facing each other, and the inner surfaces 66*a* of the non-pressing units 66 have pairs of curved non-pressing surfaces having a curved shape and facing each other that connect the ends of the pairs of flat pressing surfaces. As illustrated in the drawings, the curved non-pressing surfaces may have an arc-like cross section overall in the plane orthogonal to the longitudinal direction of the chamber 50. As illustrated in FIG. 5C, the holding unit 60 is configured by a cylindrical metal object of uniform thickness.

Figure 6A:
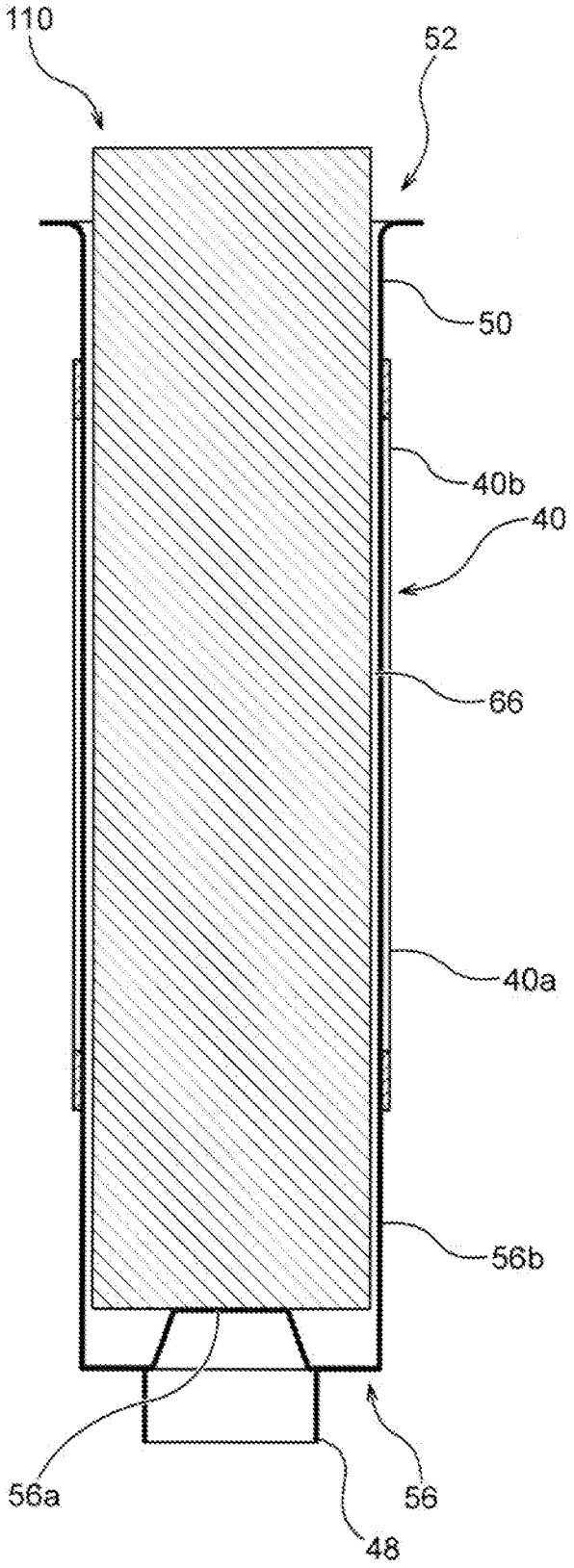
FIG. 6A is a longitudinal section of a chamber including a non-pressing unit, in which a consumable is positioned at a desired position in the chamber.

FIG. 6A is a longitudinal section of the chamber 50 including the non-pressing unit 66, in which the consumable 110 is positioned at a desired position in the chamber 50.

Figure 6B:
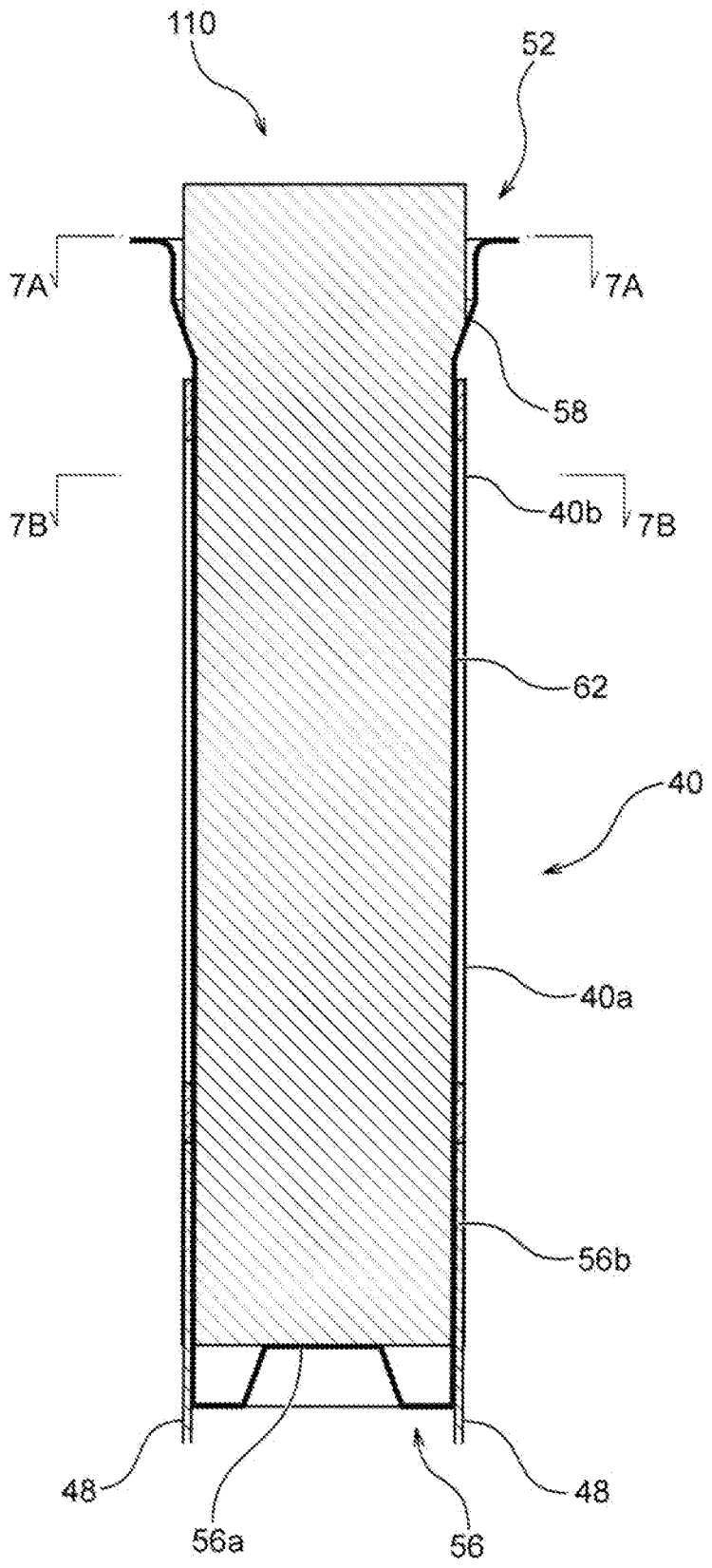
FIG. 6B is a longitudinal section of a chamber including a pressing unit, in which a consumable is positioned at a desired position in the chamber.
Figure 7A:
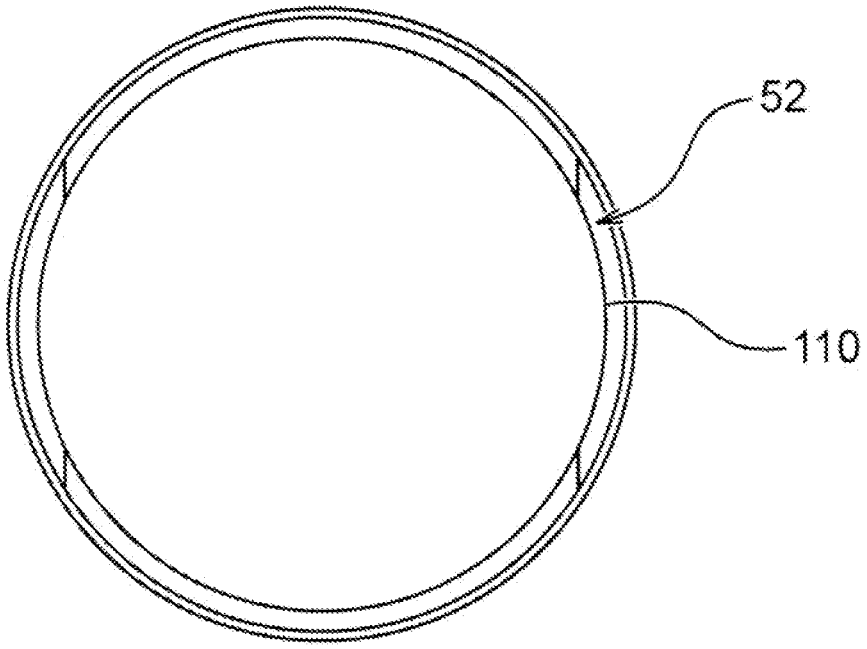
FIG. 7A is a cross section of the chamber taken along the arrow 7A-7A illustrated in FIG. 6B.
Figure 7B:
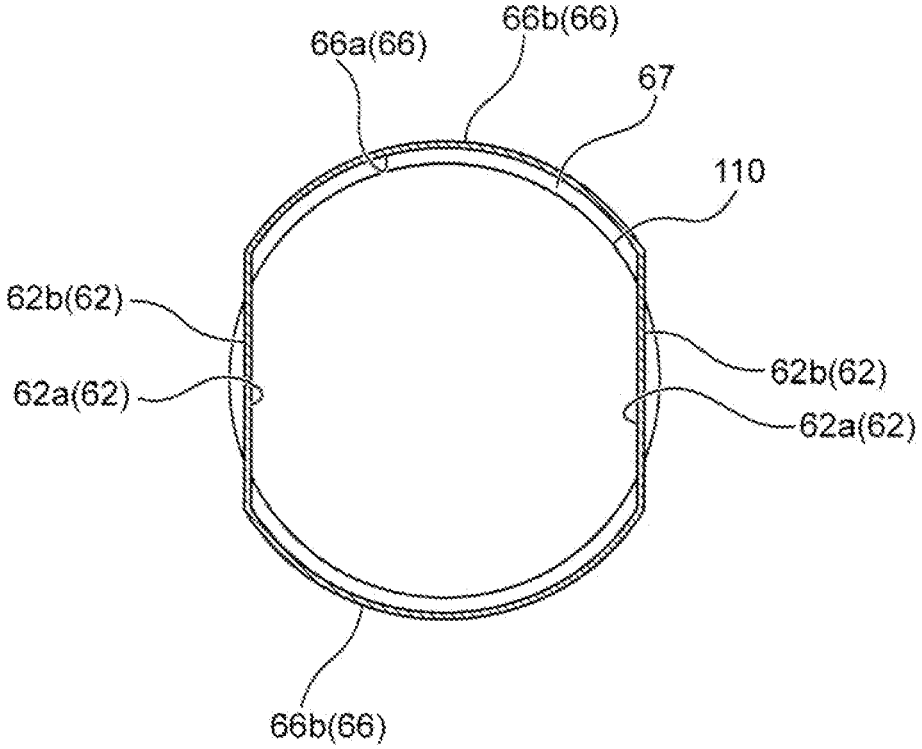
FIG. 7B is a cross section of the chamber taken along the arrow 7B-7B illustrated in FIG. 6B.

FIG. 6B is a longitudinal section of the chamber 50 including the pressing units 62, in which the consumable 110 is positioned at a desired position in the chamber 50. FIG. 7A is a cross section of the chamber 50 taken along the arrow 7A-7A illustrated in FIG. 6B. FIG. 7B is a cross section of the chamber 50 taken along the arrow 7B-7B illustrated in FIG. 6B. Note that in FIG. 7B, a cross section of the consumable 110 before being pressed is illustrated to make it easy to understand how the consumable 110 is pressed by the pressing units 62.

As illustrated in FIG. 7B, an air gap 67 between the inner surface 66*a* of the non-pressing unit 66 and the consumable 110 is substantially maintained even if the consumable 110 is positioned at the desired position in the chamber 50 and the consumable 110 is pressed by the pressing units 62 and deformed. The air gap 67 may connect the opening 52 of the chamber 50 with the end surface (the lower end surface in FIGS. 6A and 6B) of the consumable 110 positioned inside the chamber 50. The air gap 67 can also connect the opening 52 of the chamber 50 with the end surface (the lower end surface in FIGS. 6A and 6B) of the consumable 110 positioned inside the chamber 50 away from the opening 52 of the chamber 50. With this arrangement, it is not necessary to provide the smoking system 100 with a separate channel for introducing air to be supplied to the consumable 110, and therefore the structure of the smoking system 100 can be simplified. Furthermore, since the location where a part of the air gap 67 is formed in the non-pressing unit 66 is exposed, the channel can be cleaned easily. From the perspective of factors such as draw resistance, the height of the air gap 67 between the inner surface 66*a* of the non-pressing unit 66 and the consumable 110 is preferably equal to or greater than 0.1 mm and less than or equal to 1.0 mm, more preferably equal to or greater than 0.2 mm and less than or equal to 0.8 mm, most preferably equal to or greater than 0.3 mm and less than or equal to 0.5 mm.

As illustrated in FIGS. 3 to 6, the chamber 50 has a bottom unit 56. As illustrated in FIG. 6B, the bottom unit 56 supports a part of the consumable 110 inserted into the chamber 50 such that at least a part of the end surface of the consumable 110 is exposed. Also, the bottom unit 56 may support a part of the consumable 110 such that the exposed end surface of the consumable 110 is connected to the air gap 67.

As illustrated in FIGS. 4, 6A, and 6B, the bottom unit 56 of the chamber 50 has a bottom wall 56*a*, and may additionally have side walls 56*b*. The width of the bottom unit 56 demarcated by the side walls 56*b* may decrease toward the bottom wall 56*a*. As illustrated in FIGS. 5C and 7B, the inner surface 66*a* of the non-pressing unit 66 of the holding unit 60 is curved in the plane orthogonal to the longitudinal direction of the chamber 50.

The shape of the inner surface 66*a* of the non-pressing unit 66 in the plane orthogonal to the longitudinal direction of the chamber 50 is preferably the same as the shape of the opening 52 in the plane orthogonal to the longitudinal direction of the chamber 50 at any position in the longitudinal direction of the chamber 50. In other words, the inner surface 66*a* of the non-pressing unit 66 preferably is formed such that the inner surface of the chamber 50 that forms the opening 52 extends in the longitudinal direction.

As illustrated in FIGS. 2 to 4, the chamber 50 preferably includes a cylindrical non-holding unit 54 between the opening 52 and the holding unit 60. In the state with the consumable 110 positioned at the desired position in the chamber 50, a gap may be formed between the non-holding unit 54 and the consumable 110.

As illustrated in FIGS. 4 to 7, the outer circumferential surface of the holding unit 60 preferably has the same shape and size (outer circumferential length of the holding unit 60 in the plane orthogonal to the longitudinal direction of the holding unit 60) throughout the entire length of the holding unit 60 in the longitudinal direction.

Also, as illustrated in FIGS. 3, 4, 5B, and 6B, the chamber 50 preferably has a first guide unit 58 provided with a tapered surface 58*a* that connects the inner surface of the chamber 50 forming the opening 52 to the inner surfaces 62*a* of the pressing units 62.

As illustrated in FIG. 2, the heating unit 40 includes a heating element 42. The heating element 42 may be a heating track, for example. As illustrated in FIG. 5C for example, the outer surfaces 62*b* of the pressing units 62 and the outer surface 66*b* of the non-pressing unit 66 may be connected to one another at an angle, and a boundary 71 may be formed between the outer surface 62*b* of the pressing units 62 and the outer surface 66*b* of the non-pressing unit 66. The heating track preferably extends in a direction crossing the direction in which the boundary 71 extends (the longitudinal direction of the chamber), preferably in the direction at a right angle to the direction in which the boundary 71 extends.

As illustrated in FIG. 2, in addition to the heating element 42, the heating unit 40 preferably includes an electrical insulation member 44 that covers at least one surface of the heating element 42. In the present embodiment, the electrical insulation member 44 is disposed to cover the surfaces on either side of the heating element. In addition, the electrical insulation member 44 preferably is disposed inside the region of the outer surface of the holding unit 60. In other words, the electrical insulation member 44 preferably is disposed so as not to stick out from the outer surface of the holding unit 60 on the first guide unit 58 side of the chamber 50 in the longitudinal direction. As described above, the first guide unit 58 is provided between the opening 52 and the pressing units 62, and therefore the shape of the outer surface of the chamber 50 and the outer circumferential length of the chamber in the plane orthogonal to the longitudinal direction of the chamber may vary in the longitudinal direction of the chamber 50. For this reason, by disposing the electrical insulation member 44 on the outer surface of the holding unit 60, it is possible to keep slack from occurring.

Furthermore, the device 120 preferably is provided with a sheet that covers the chamber 50 and the heating unit 40 and secures the heating unit 40 to the outer surface of the chamber 50. With this arrangement, the heating unit 40 can be secured firmly and closely onto the outer surface of the chamber 50, thereby improving the heating efficiency further and stabilizing the structure around the chamber 50. Additionally, the sheet preferably is disposed on the outer surface of the holding unit 60. In other words, the sheet preferably is disposed so as not to stick out from over the outer surface of the holding unit 60 on the first guide unit 58 side of the chamber 50 in the longitudinal direction. As described above, the first guide unit 58 is provided between the opening 52 and the holding unit 60, and therefore the shape of the outer surface of the chamber 50 and the outer circumferential length of the chamber in the plane orthogonal to the longitudinal direction of the chamber may vary in the longitudinal direction of the chamber 50. For this reason, by disposing the sheet on the outer surface of the holding unit 60, it is possible to keep slack from occurring.

Preferably, the heating unit 40 is not disposed on at least one selected from the group consisting of the outer surface of the chamber 50 between the opening 52 and the first guide unit 58, or in other words the outer surface of the non-holding unit 54, the outer surface of the first guide unit 58, and the outer surface of the non-pressing unit 66. The heating unit 40 preferably is disposed over the entire outer surfaces 62*b* of the pressing units 62.

In the first embodiment, as illustrated in FIG. 2, the device 120 includes band-shaped electrodes 48 extending from the heating unit 40. The band-shaped electrodes 48 preferably extend from the flat outer surfaces 62*b* of the pressing units 62 to the outside of the outer surfaces 62*b* of the pressing units 62 in a state with the heating unit 40 disposed on the outer surfaces 62*b* of the pressing units 62. As illustrated in FIG. 2, the band-shaped electrodes 48 extend from the outer surface 62*b* of each of two pressing units 62. However, the configuration is not limited thereto, and the band-shaped electrodes 48 may also extend from the outer surface 62*b* of only one of the two pressing units 62. Also, as illustrated in FIG. 2, the band-shaped electrodes 48 extend toward the opposite side away from the opening 52 side of the chamber. The band-shaped electrodes 48 may have a structure in which layers containing conductive tracks are arranged between two layers containing an electrical insulation material.

Also, as illustrated in FIGS. 2, 6A, and 6B, the heating unit 40 includes a first portion 40*a* positioned on the opposite side from the opening 52 and a second portion 40*b* positioned on the opening 52 side. The heater power density of the second portion 40*b* is preferably higher than the heater power density of the first portion 40*a*. Alternatively, the rate of temperature increase in the second portion 40*b* is preferably higher than the rate of temperature increase in the first portion 40*a*. Alternatively, the heating temperature of the second portion 40*b* is preferably higher than the heating temperature of the first portion 40*a* over any equal time. In the state in which the consumable 110 is positioned at the desired position in the chamber 50, the second portion 40*b* preferably covers the outer surface of the holding unit 60 corresponding to at least ½ the smokable substance included in the consumable 110 in the longitudinal direction of the smokable substance.

Figure 8:
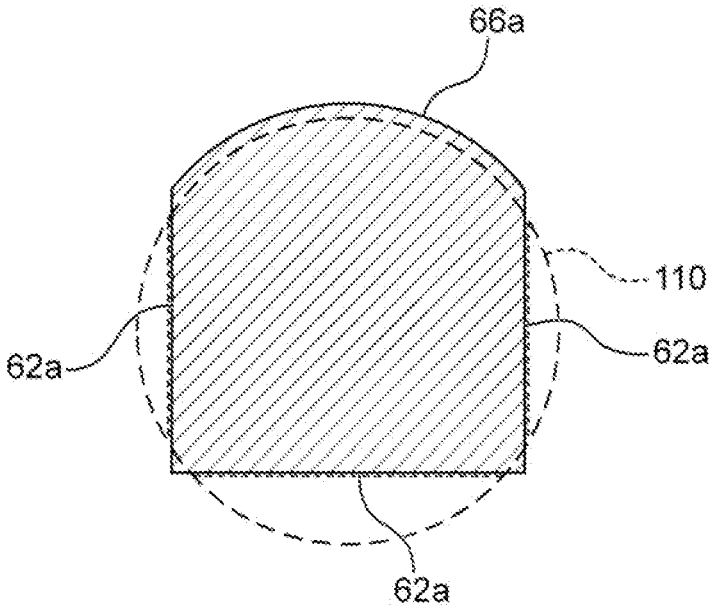
FIG. 8 is a diagrammatic cross section illustrating another example of a pressing unit of a chamber.

In the embodiment described above, the chamber 50 includes a pair of pressing units 62 facing each other, but the shape of the chamber is not limited thereto. FIGS. 8 to 11 are diagrammatic cross sections illustrating other examples of the pressing units 62 of the chamber 50. In FIGS. 8 to 11, a cross section of the consumable 110 before being pressed is illustrated with a dashed line to make it easy to understand how the consumable 110 is pressed by the pressing units 62. In the example illustrated in FIG. 8, the chamber 50 includes three pressing units 62 having flat inner surfaces 62*a*, and one non-pressing unit 66 (inner surface 66*a*). Among the three pressing units 62, a pair of the pressing units 62 (inner surfaces 62*a*) face each other. The remaining pressing unit 62 and the non-pressing unit 66 are each provided between the pair of pressing units 62 and face each other. As illustrated in FIG. 8, the distance between the pair of pressing units 62 having the flat inner surfaces 62*a* is smaller than the diameter of the inserted consumable 110 having a circular cross section. With this arrangement, when the consumable 110 is placed inside the chamber 50, the consumable 110 is pressed by the inner surfaces 62*a* of the pressing units 62.

Figure 9:
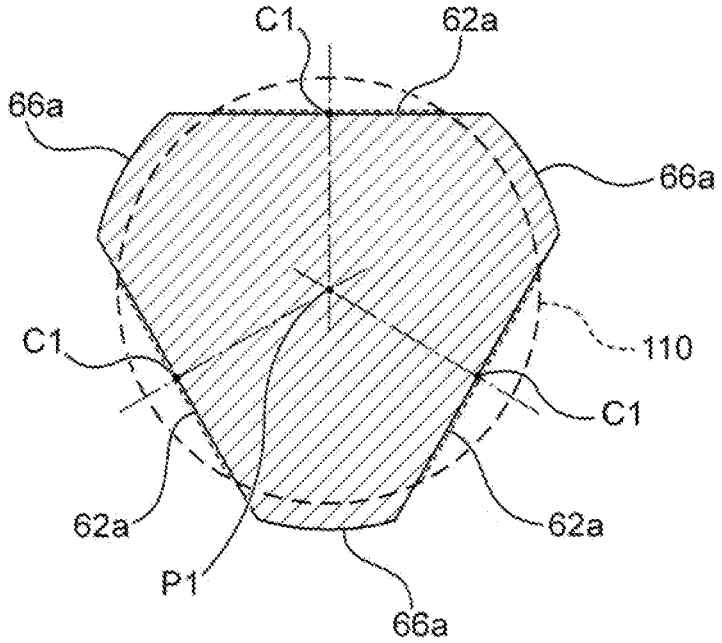
FIG. 9 is a diagrammatic cross section illustrating another example of a pressing unit of a chamber.

In the example illustrated in FIG. 9, the chamber 50 includes three pressing units 62 (inner surfaces 62*a*) and three non-pressing units 66 (inner surfaces 66*a*) provided between each of the three pressing units 62. The inner surfaces 62*a* of the pressing units 62 are flat surfaces, whereas the inner surfaces 66*a* of the non-pressing units 66 are curved surfaces. Each pressing unit 62 faces a respective non-pressing unit 66. In the cross section illustrated in FIG. 9, that is, in the plane orthogonal to the longitudinal direction of the chamber, the distance between the point P1 where the lines extending perpendicularly from the center C1 of the inner surface 62*a* of each pressing unit 62 intersect and the center C1 of each of the inner surfaces 62*a* of the pressing units 62 is shorter than the radius of the inserted consumable 110 having a circular cross section. With this arrangement, when the consumable 110 is placed inside the chamber 50, the consumable 110 is pressed by the pressing units 62.

Figure 10:
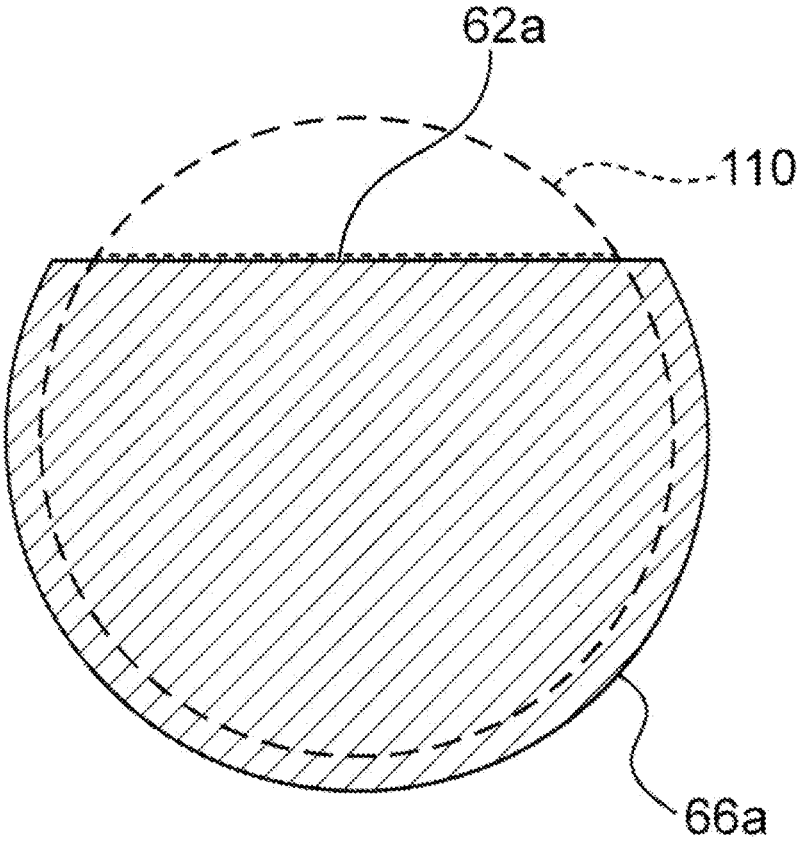
FIG. 10 is a diagrammatic cross section illustrating another example of a pressing unit of a chamber.

In the example illustrated in FIG. 10, the chamber 50 includes one pressing unit 62 (inner surface 62*a*) and one non-pressing unit 66 (inner surface 66*a*). The inner surface 62*a* of the pressing unit 62 is a flat surface, whereas the inner surface 66*a* of the non-pressing unit 66 is a curved surface. The cylindrical holding unit 60 is formed by the pressing unit 62 and the non-pressing unit 66.

Figure 11:
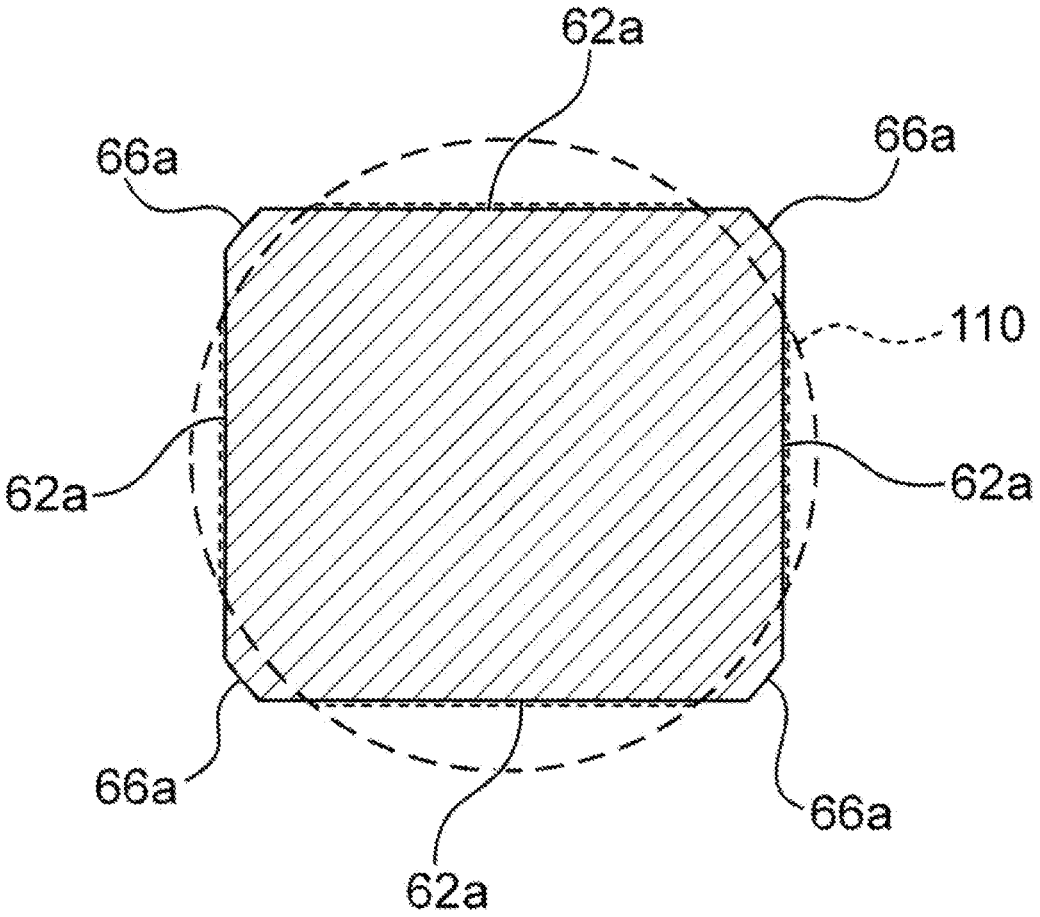
FIG. 11 is a diagrammatic cross section illustrating another example of a pressing unit of a chamber.

In the example illustrated in FIG. 11, the chamber 50 includes four pressing units 62 (inner surfaces 62*a*) and four non-pressing units 66 (inner surfaces 66*a*). The inner surfaces 62*a* of the pressing units 62 are flat surfaces, whereas the inner surfaces 66*a* of the non-pressing units 66 are curved surfaces connecting the inner surfaces 62*a* of adjacent pressing units 62. Two of the pressing units 62 (inner surfaces 62*a*) face each other, and the remaining two pressing units 62 (inner surfaces 62*a*) face each other. At least one of the distance between one pair of pressing units 62 (inner surfaces 62*a*) facing each other or the distance between the other pair of pressing units 62 (inner surfaces 62*a*) facing each other is shorter than the diameter of the consumable 110. With this arrangement, when the consumable 110 is placed inside the chamber 50, the consumable 110 is pressed by the pressing units 62.

As illustrated in FIGS. 8 to 11 above, there may be at least one pressing unit 62, but three or more may also exist in the circumferential direction of the chamber 50. Also, the pressing units 62 may be disposed so as to face each other, but may also be disposed to face each of the non-pressing units 66. Also, like the examples illustrated in FIGS. 8 and 10, in the case where the consumable 110 is biased in the direction of the pressure received from the pressing unit 62 in the plane orthogonal to the longitudinal direction of the chamber (in FIG. 8, the consumable 110 is subjected to an upward pressure from the bottom of the diagram, and in FIG. 10 the consumable 110 is subjected to a downward pressure from the top of the diagram), a support may also be provided between the consumable 110 and the device 120 such that the consumable 110 does not move and contact the inner surface 66*a* of the non-pressing unit 66. The support may be provided at a location corresponding to the smokable substance of the consumable 110, and may also be provided at a non-corresponding location. Note that although FIGS. 8 to 11 illustrate the consumable 110 before being pressed, in the case where the air gap 67 is formed between the non-pressing unit 66 and the consumable 110, even if the consumable 110 is pressed by the pressing unit 62 and deformed, the air gap 67 is substantially maintained between the inner surface 66*a* of the non-pressing unit 66 and the consumable 110. On the other hand, like the fourth embodiment described later, the consumable 110 may also be pressed by the pressing unit 62 and deformed such that the inner surface 66*a* of the non-pressing unit 66 and the consumable 110 touch.

Figure 12:
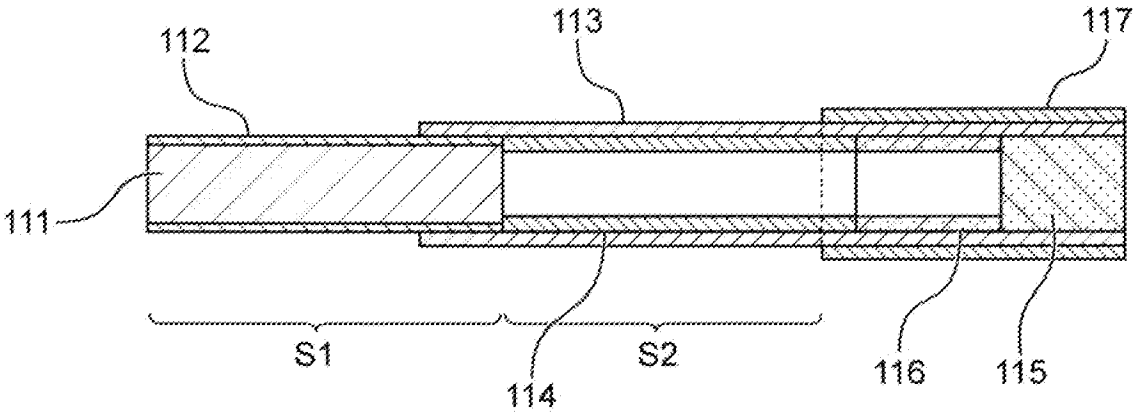
FIG. 12 is a diagrammatic lateral section of a consumable.

Next, the consumable 110 used in the smoking system 100 will be described in detail. FIG. 12 is a diagrammatic lateral section of the consumable 110. In the embodiment illustrated in FIG. 2, the consumable 110 includes a smokable substance 111, a cylindrical member 114, a hollow filter unit 116, and a filter unit 115. A smokable substance 111 is wrapped by a first wrap paper 112. The cylindrical member 114, the hollow filter unit 116, and the filter unit 115 are wrapped by a second wrap paper 113 different from the first wrap paper 112. The second wrap paper 113 also wraps a part of the first wrap paper 112 used to wrap the smokable substance 111. With this arrangement, the cylindrical member 114, hollow filter unit 116, and filter unit 115 are joined to the smokable substance 111. However, the second wrap paper 113 may also be omitted, and the first wrap paper 112 may be used to join the cylindrical member 114, hollow filter unit 116, and filter unit 115 to the smokable substance 111. The outer surface near the end of the second wrap paper 113 on the filter unit 115 side is coated with a lip release agent 117 for making the user's lips not stick readily to the second wrap paper 113. The portion of the consumable 110 coated with the lip release agent 117 functions as the mouthpiece of the consumable 110.

In the present embodiment, the portion corresponding to the smokable substance 111 and the first wrap paper 112 is designated a first portion S1. Also, at least a part of the portion corresponding to the cylindrical member 114 is designated a second portion S2. More specifically, the portion of the cylindrical member 114 wrapped by the second wrap paper 113 not coated with the lip release agent 117 is designated the second portion S2.

The first portion S1 includes the smokable substance 111, such as tobacco for example. Also, in the first portion S1, the first wrap paper 112 wrapping the smokable substance 111 may be an air-permeable sheet member. A lid for preventing the smokable substance 111 from falling out may also be provided at the end of the first portion S1. The lid may be affixed to the first wrap paper 112 with glue, for example. The lid may also be secured to the first wrap paper 112 by frictional force. The lid may be a paper filter or an acetate filter, for example. The cylindrical member 114 provided in the second portion S2 may be a paper tube or a hollow filter.

In the example illustrated in the drawings, the consumable 110 is provided with the smokable substance 111, the cylindrical member 114, the hollow filter unit 116, and the filter unit 115, but the configuration of the consumable 110 is not limited thereto. For example, the hollow filter unit 116 may be omitted, and the cylindrical member 114 and the filter unit 115 may be disposed adjacent to each other.

As illustrated in the drawings, the first portion S1 of the consumable 110 is disposed closer to the longitudinal end of the consumable 110 than the second portion S2. The first portion S1 has a first hardness, and the second portion S2 has a second hardness. The first hardness is preferably equal to or greater than 65% and less than or equal to 90%, more preferably equal to or greater than 70% and less than or equal to 85%, most preferably equal to or greater than 73% and less than or equal to 82%.

When the consumable 110 is inserted into the chamber 50, the consumable 110 is positioned such that at least a part of the second portion S2 is pressed against the inner surface 62*a* of the pressing unit 62. The second hardness is preferably equal to or greater than 90% and less than or equal to 99%, more preferably equal to or greater than 90% and less than or equal to 98%, most preferably equal to or greater than 92% and less than or equal to 96%. With this arrangement, insertion is performed easily and the consumable 110 is held firmly by the holding unit 60.

The second hardness preferably is higher than the first hardness. According to this configuration, easy insertion of the consumable 110 into the holding unit 60 and firm holding of the consumable 110 may be achieved at the same time. Also, by changing from the state in which only the first portion S1 is pressed against the inner surface 62*a* of the pressing unit 62 to the state in which the second portion S2 is also pressed against the inner surface 62*a* of the pressing unit 62 when the consumable 110 is inserted into the chamber 50, the user can feel a change in resistance when inserting the consumable 110. As a result, during insertion the user can know how far the consumable 110 has been inserted into the chamber 50 and use this information as a clue for learning how much farther the consumable 110 should be inserted to reach the desired insertion position, thereby making it easier to position the consumable 110 at the desired position. This change in resistance can be felt more clearly in the case where the first portion S1 and the second portion S2 are disposed adjacent to each other, as illustrated in FIG. 12.

Figure 13:
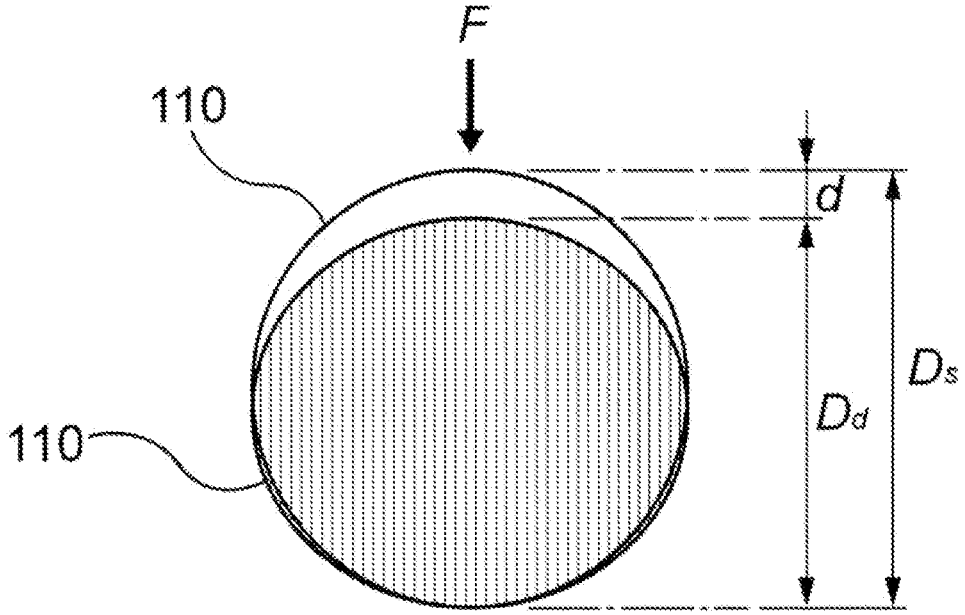
FIG. 13 illustrates a cross section of a consumable before and after a load is imposed.

As described above, the term "hardness" as used throughout this specification means resistance against deformation. Hardness is generally expressed as a ratio. FIG. 13 illustrates a cross section of the consumable 110 before and after a load F is imposed. As illustrated in the drawing, let $D_s$ be the diameter of the consumable before a load is imposed, and let $D_d$ be the diameter of the consumable 110 after a predetermined load is imposed and in the direction in which the load is imposed. The deformation d of the consumable when a predetermined load is imposed can be expressed as $D_s - D_d$. In this case, the hardness (%) is expressed by Dd/Ds×100 (%).

Preferably, the length of the first portion S1 of the consumable 110 in the longitudinal direction is less than or equal to the length of the inner surface 62*a* of the pressing unit 62 in the longitudinal direction, and when the consumable 110 is inserted into the chamber 50, the consumable 110 is positioned in the chamber 50 such that the first portion S1 of the consumable 110 does not stick out from the inner surface 62*a* of the pressing unit 62 in the longitudinal direction of the chamber 50. Also, when the consumable 110 is positioned at the desired position in the chamber 50, the entire outer circumferential surface of the smokable substance of the consumable 110 preferably is covered by the holding unit 60.

The distance over which the second portion S2 of the consumable 110 is inserted into the holding unit 60 when the consumable 110 is positioned at the desired position inside the chamber 50 is preferably equal to or greater than 1.0 mm and less than or equal to 10.0 mm, more preferably equal to or greater than 2.0 mm and less than or equal to 8.0 mm, most preferably equal to or greater than 4.0 mm and less than or equal to 6.0 mm.

The length of the chamber 50 from the bottom wall 56*a* to the end on the opening 52 side of the pressing unit 62 is longer than the length of the first portion S1 of the consumable 110 in the longitudinal direction (hereinafter referred to as the length of the first portion), and is also preferably shorter than 1.5 times the length of the first portion S1, more preferably shorter than 1.35 times. Also, when the consumable 110 is inserted into the chamber 50, at least a part of the first portion S1 of the consumable 110 preferably is positioned closer to the opening 52 than a central part of the holding unit 60 in the longitudinal direction. In other words, the end of the first portion S1 on the second portion S2 side preferably is positioned closer to the opening 52 than the central part of the holding unit 60 in the longitudinal direction. With this arrangement, a change in resistance can be felt because the second portion S2 is inserted into the holding unit 60 before the first portion S1 of the consumable 110 abuts the bottom wall 56*a* of the chamber 50, and since the insertion position where the change is felt can be set to a position relatively close to the desired insertion position of the consumable 110, the consumable 110 is positioned at the desired position more easily, and the feel of using the device may be improved for the user.

Second Embodiment

Figure 14:
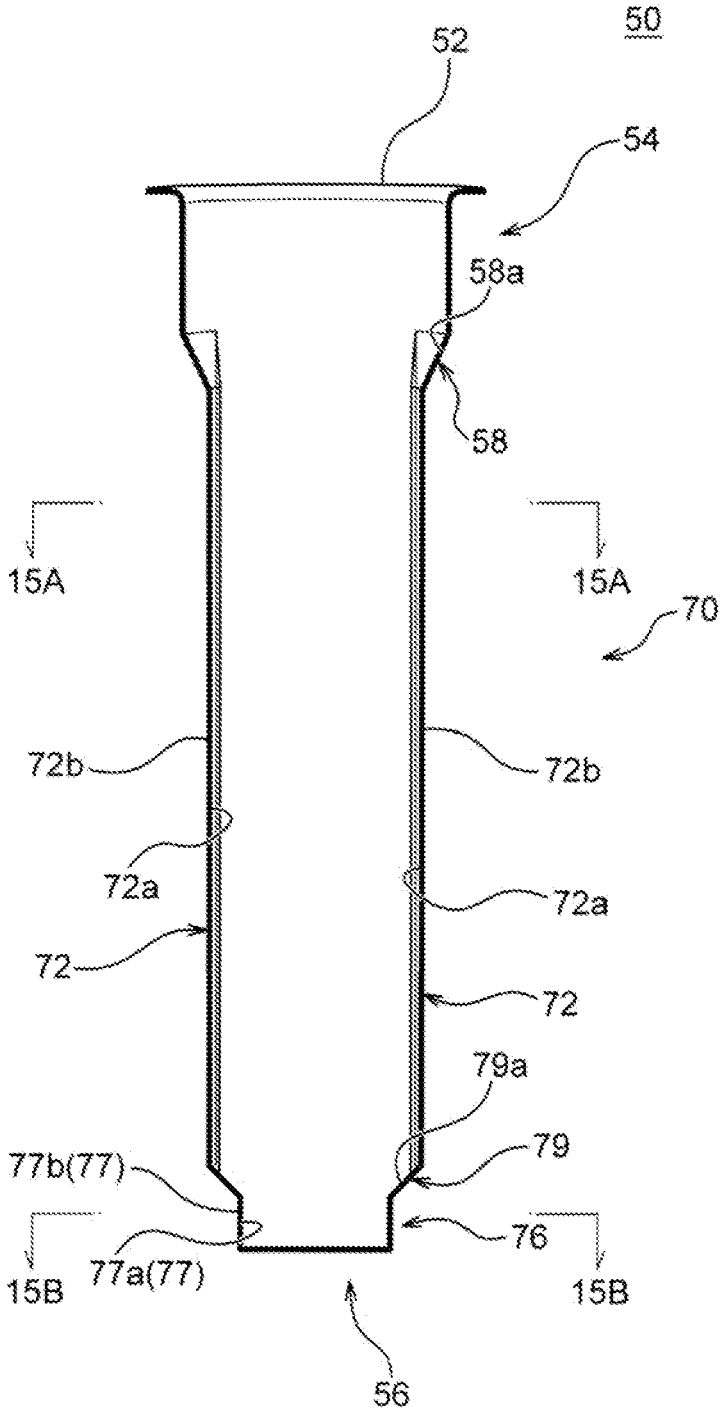
FIG. 14 is a diagrammatic cross section of a chamber provided in a device of a smoking system according to a second embodiment.
Figure 15A:
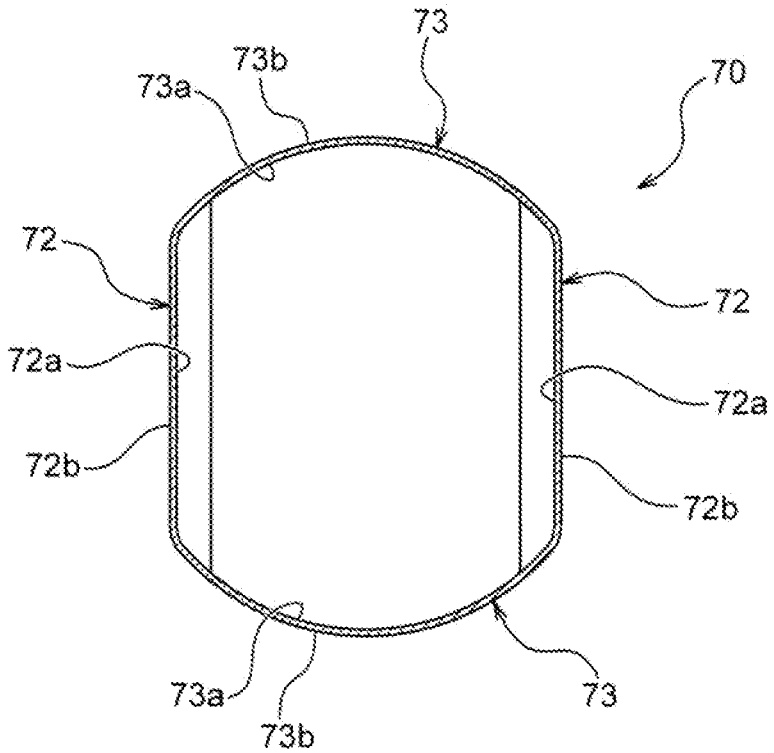
FIG. 15A is a cross section of the chamber taken along the arrow 18A-18A illustrated in FIG. 14.
Figure 15B:
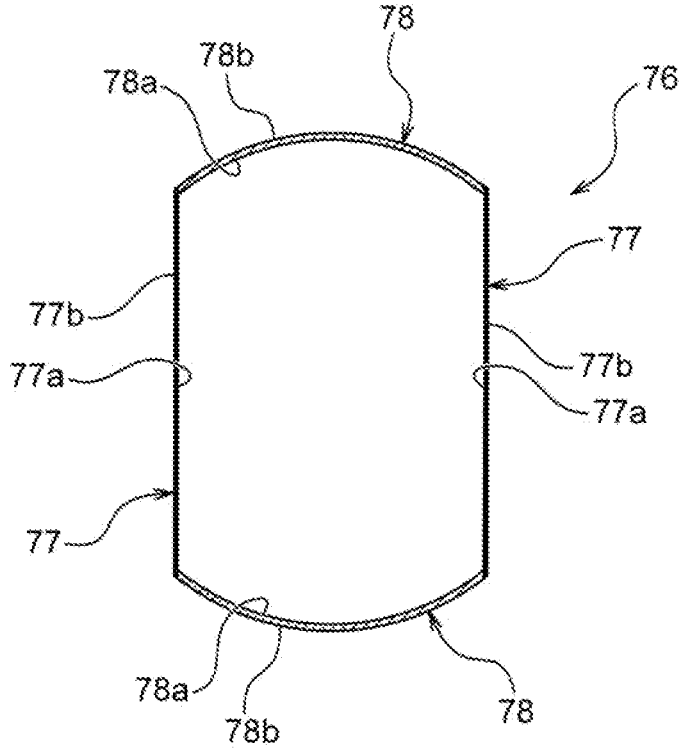
FIG. 15B is a cross section of the chamber taken along the arrow 18B-18B illustrated in FIG. 14.

Next, a smoking system 100 according to a second embodiment will be described. In the smoking system 100 of the second embodiment, the structure of the chamber 50 is different compared to the smoking system 100 of the first embodiment. FIG. 14 is a diagrammatic cross section of the chamber 50 provided in the device 120 of the smoking system 100 according to the second embodiment. FIG. 15A is a cross section of the chamber 50 taken along the arrow 18A-18A illustrated in FIG. 14. FIG. 15B is a cross section of the chamber 50 taken along the arrow 18B-18B illustrated in FIG. 14. Specifically, the chamber 50 of the second embodiment differs from the chamber 50 of the first embodiment by being provided with a first holding unit 70 and a second holding unit 76.

The first holding unit 70 is configured to hold the consumable 110 inserted into the chamber 50. The second holding unit 76 is positioned farther away from the opening 52 in the chamber 50 than the first holding unit 70, and is configured to holding the consumable 110 inserted into the chamber 50. The first holding unit 70 includes first pressing units 72, which press a part of the consumable 110, and first non-pressing units 73. The first pressing units 72 have inner surfaces 72*a* and outer surfaces 72*b*. The first non-pressing units 73 have inner surfaces 73*a* and outer surfaces 73*b*. The second holding unit 76 includes second pressing units 77, which press a part of the consumable 110, and second non-pressing units 78. The second pressing units 77 have inner surfaces 77*a* and outer surfaces 77*b*. The second non-pressing units 78 have inner surfaces 78*a* and outer surfaces 78*b*.

In the state in which the consumable 110 is held by the first holding unit 70 and the second holding unit 76, the second holding unit 76 is configured to compress the consumable 110 more than the first holding unit 70. Specifically, for example, the internal cross-sectional area of the second holding unit 76 is smaller than the internal cross-sectional area of the first holding unit 70 in the plane orthogonal to the longitudinal direction of the chamber 50, as illustrated in FIGS. 15A and 15B. By having the inner surfaces 72*a* of the first pressing units 72 press the consumable 110, the consumable 110 is substantially close to the heating surface (the inner surfaces 72*a* of the first pressing units 72) in the first holding unit 70, and therefore heat from the heating unit 40 can be transferred to the consumable 110 efficiently. At the same time, the draw resistance during smoking can be adjusted by the pressing of the second holding unit 76. The heating unit 40 does not have to be disposed on the outer surfaces 77*b* of the second pressing units 77. In particular, by not disposing the heating unit 40 on the second holding unit 76 in the case where the portion of the consumable 110 that is pressed by the second holding unit 76 is the lid described above, heating that does not efficiently contribute to the heating of the smokable substance may be suppressed.

As illustrated in FIG. 14, the chamber 50 has a second guide unit 79 provided with a tapered surface 79*a* that connects the inner surfaces 72*a* of the first pressing units 72 to the inner surfaces 77*a* of the second pressing units 77. The second guide unit 79 can be used to change the cross-sectional shape of the inner surface of the chamber 50 continuously from the first pressing units 72 to the second pressing units 77, thereby making it possible to insert the consumable 110 into the second holding unit 76 smoothly.

As illustrated in FIG. 15A, the inner surfaces 72*a* of the first pressing units 72 of the first holding unit 70 face each other. In other words, the inner surfaces 72*a* of the first pressing units 72 form a pair of first pressing surfaces. As illustrated in FIG. 15B, the inner surfaces 77*a* of the second pressing units 77 of the second holding unit 76 face each other. In other words, the inner surfaces 77*a* of the second pressing units 77 form a pair of second pressing surfaces. The shortest distance between the second pressing surfaces is preferably less than the shortest distance between the first pressing surfaces. Also, in the embodiment illustrated in the diagrams, the first pressing surfaces and the second pressing surfaces are flat surfaces. As illustrated in FIGS. 15A and 15B, the pressing surfaces of the second holding unit 76 and the pressing surfaces of the first holding unit 70 face the same direction in the direction orthogonal to the longitudinal direction of the chamber 50.

As illustrated in FIG. 14, the second holding unit 76 is disposed at the end of the chamber 50. With this arrangement, in the case where the smokable substance on the end of the consumable 110 is pressed, the pressing by the second holding unit 76 compresses the smokable substance on the end of the consumable 110, and reduces situations in which the smokable substance falls out inside the chamber 50 when taking the consumable 110 out of the chamber 50 after smoking.

The inner surfaces 72*a* and outer surfaces 72*b* of the first pressing unit 72 and the inner surfaces 77*a* and outer surfaces 77*b* of the second pressing unit 77 may have features similar to the inner surfaces 62*a* and the outer surfaces 62*b* of the pressing units 62 of the first embodiment. Also, the inner surfaces 73*a* and outer surfaces 73*b* of the first non-pressing unit 73 and the inner surfaces 78*a* and outer surfaces 78*b* of the second non-pressing unit 78 may have features similar to the inner surfaces 66*a* and the outer surfaces 66*b* of the non-pressing units 66 of the first embodiment.

Third Embodiment

Figure 16:
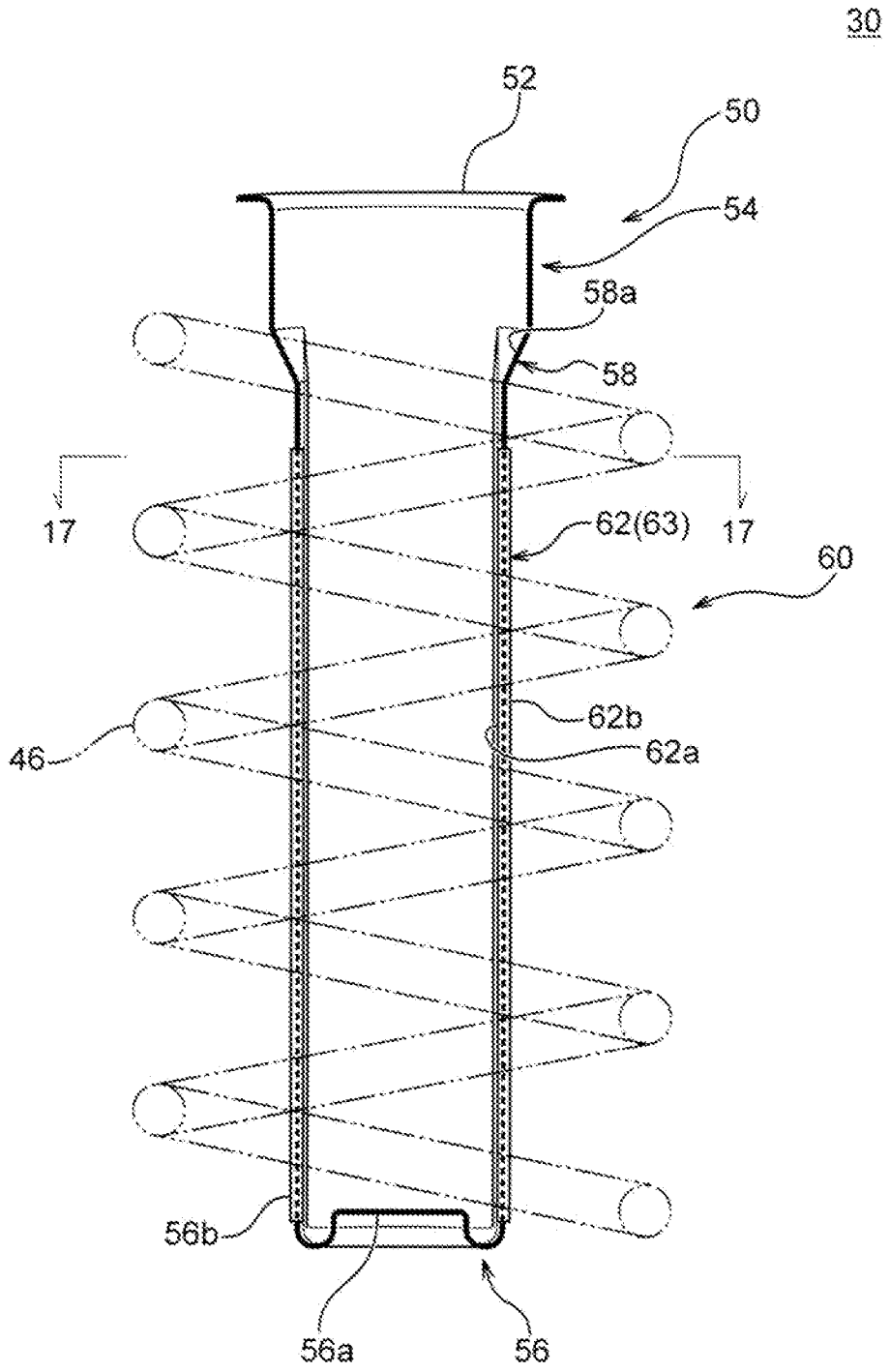
FIG. 16 is a diagrammatic cross section of a heater assembly provided in a device of a smoking system according to a third embodiment.
Figure 17:
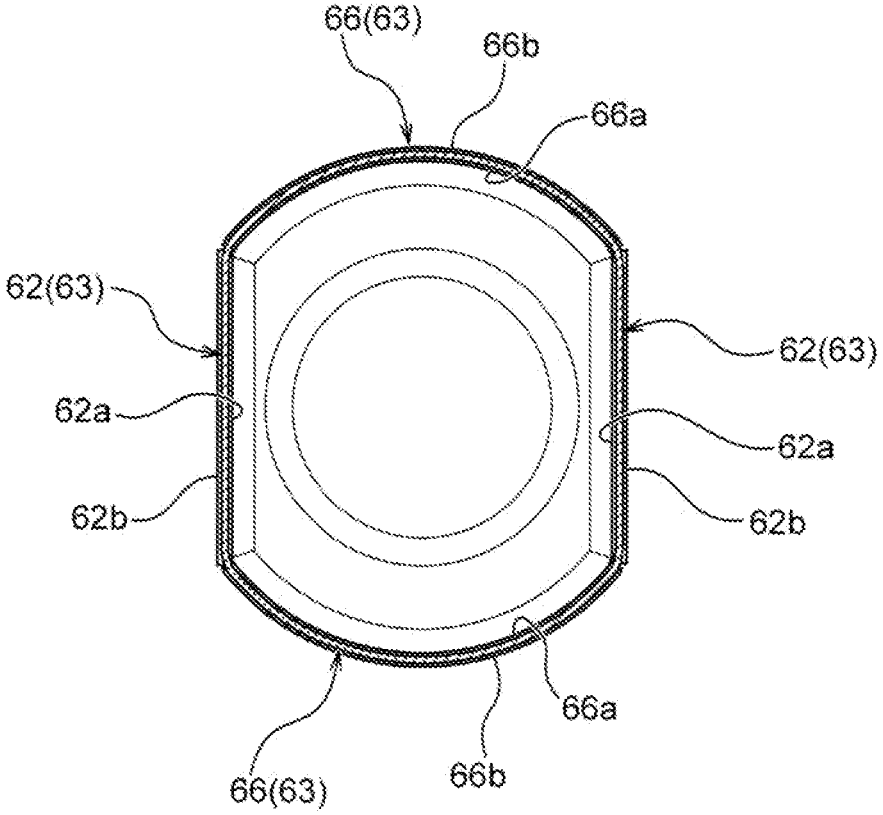
FIG. 17 is a cross section of the chamber taken along the arrow 20-20 illustrated in FIG. 16.

Next, a smoking system 100 according to a third embodiment will be described. In the smoking system 100 of the third embodiment, the structures of the chamber 50 and the heating unit 40 are different compared to the smoking system 100 of the first embodiment. FIG. 16 is a diagrammatic cross section of a heater assembly 30 provided in the device 120 of the smoking system 100 according to the third embodiment. FIG. 17 is a cross section of the chamber 50 taken along the arrow 20-20 illustrated in FIG. 16. In FIG. 16, the top cap 32 illustrated in FIG. 2 is omitted.

As illustrated in FIGS. 15 and 16, the shape of the chamber 50 is approximately the same as the shape of the chamber 50 of the first embodiment. On the other hand, in addition to the heating unit 40, the heater assembly 30 of the third embodiment is provided with an induction coil 46 that heats the chamber 50. As illustrated in FIG. 15, the induction coil 46 may also be disposed to surround the pressing unit 62 of the chamber 50. With this arrangement, energy can be supplied efficiently to the heat-generating portion of the chamber 50. Note that the induction coil 46 may also be cylindrical.

The pressing unit 62 of the chamber 50 includes a susceptor 63 that is heated by the induction coil 46. The susceptor 63 may be disposed on the outer surface 62*b* or the inner surface 62*a* of the pressing unit 62, the susceptor 63 may be included in the walls of the chamber 50 forming the pressing unit 62, or the walls of the chamber 50 forming the pressing unit 62 may be configured as the susceptor. The susceptor 63 preferably includes a material selected from at least one of the group consisting of aluminum, iron, nickel, and alloys thereof (for example, nichrome and stainless steel).

In the third embodiment, the non-pressing unit 66 of the chamber 50 also includes the susceptor 63. With this arrangement, as illustrated in FIG. 17, the susceptor 63 and the paths of current flowing through the susceptor 63 are formed into loops surrounding the space that houses the consumable 110 (the internal space of the chamber 50).

As described above, in the third embodiment, at least the pressing unit 62 includes the susceptor 63, and the susceptor 63 is heated by the induction coil 46.

Fourth Embodiment

Figure 18:
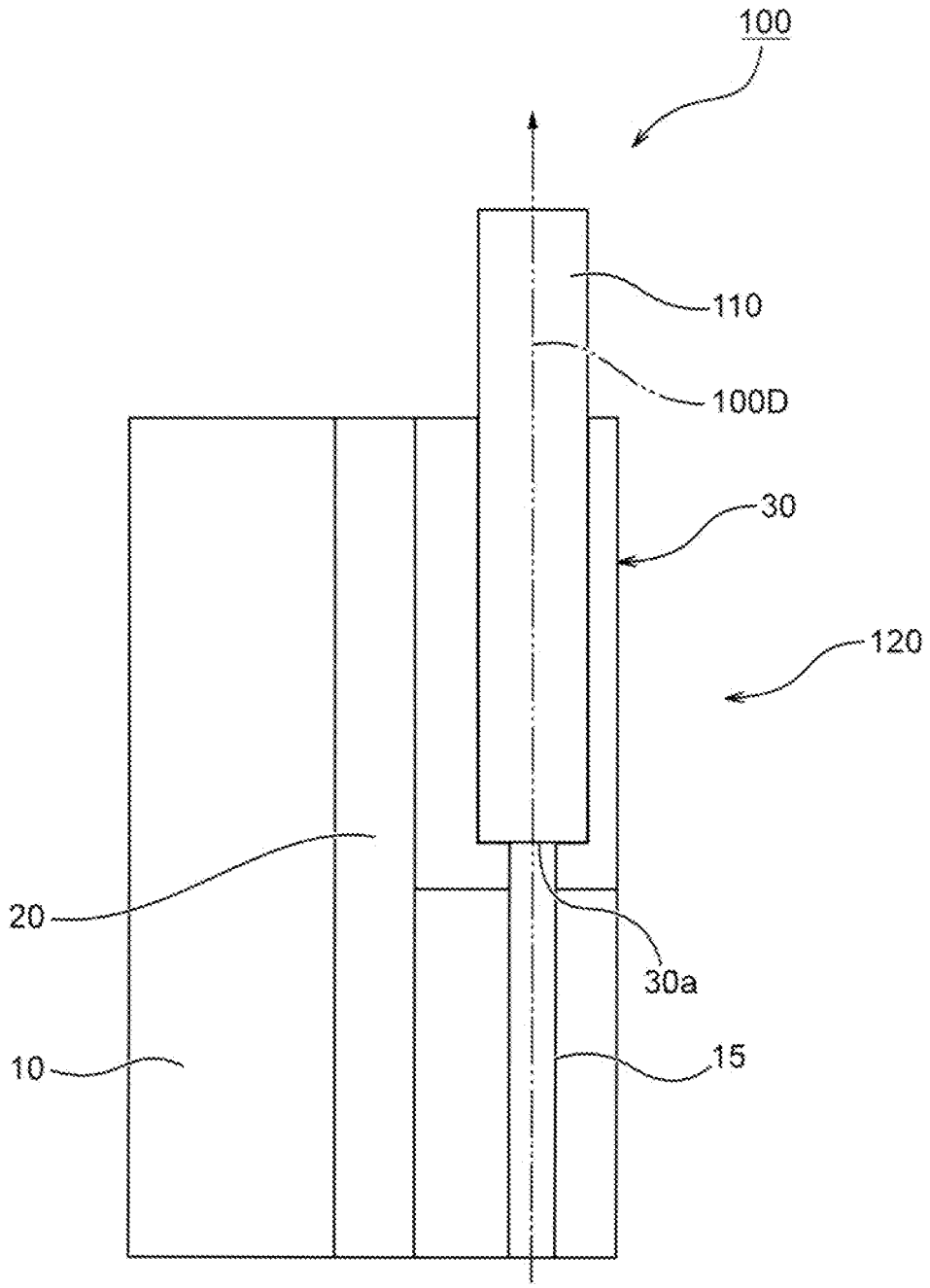
FIG. 18 is a diagram illustrating a smoking system according to a fourth embodiment.

Next, a smoking system 100 according to a fourth embodiment will be described. In the smoking system 100 of the fourth embodiment, the air flow channels of the smoking system 100 and the structure of the chamber 50 are different compared to the smoking system 100 of the first embodiment. FIG. 18 is a diagram illustrating the smoking system 100 according to the fourth embodiment.

As illustrated in FIG. 18, in the smoking system 100 of the fourth embodiment, a gap for drawing in air from between the heater assembly 30 and the consumable 110 substantially does not exist. As illustrated in FIG. 18, in the smoking system 100, an opening 30*a* for taking in air is formed in the bottom of the heater assembly 30, and an air passage 15 for drawing air into the opening 30*a* is formed. In the example illustrated in the drawings, the air passage 15 extends to connect the opening 30*a* and the bottom of the smoking system 100 (on the opposite side of the heater assembly 30 away from the opening 52 in the chamber 50 through which the consumable 110 is inserted). The air passage 15 may take any shape that connects the opening 30*a* to the outside of the smoking system 100. With this arrangement, air inhaled by the user is guided from the bottom of the smoking system 100 through the ends of the consumable 110 and into the user's mouth, as indicated by the air flow 100D.

Figure 19A:
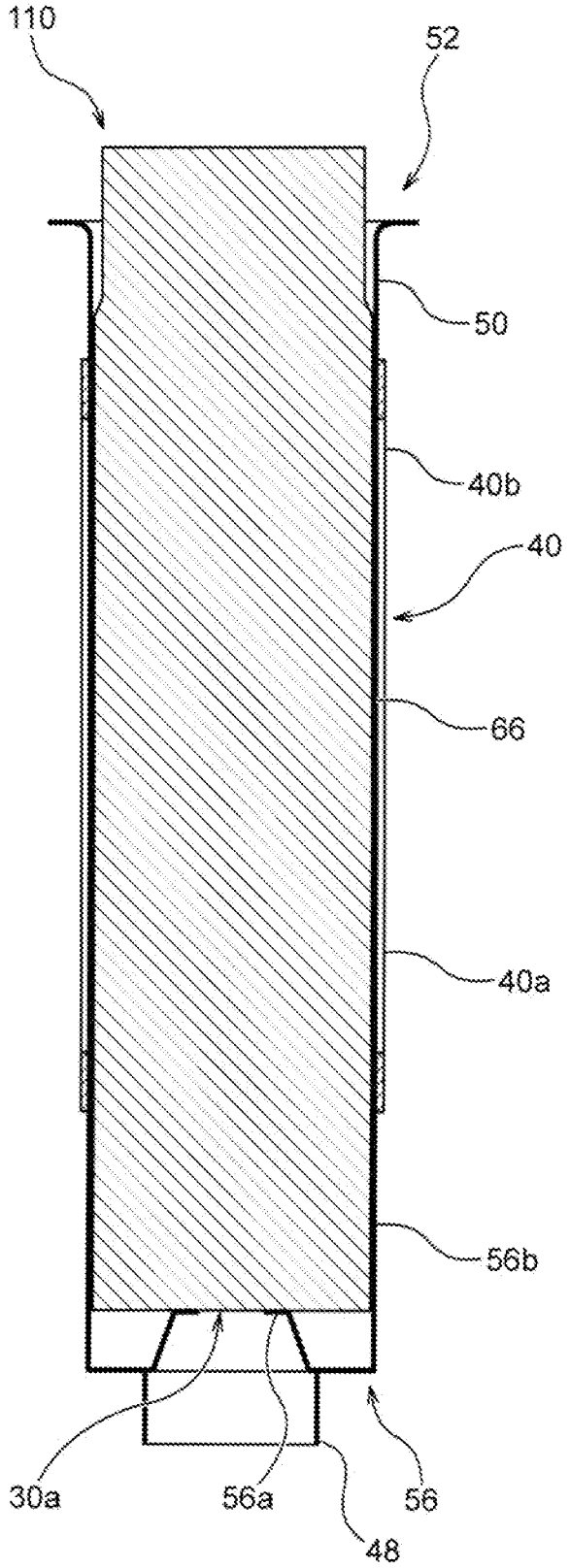
FIG. 19A is a longitudinal section of a chamber including a non-pressing unit according to the fourth embodiment, in which a consumable is positioned at a desired position in the chamber.
Figure 19B:
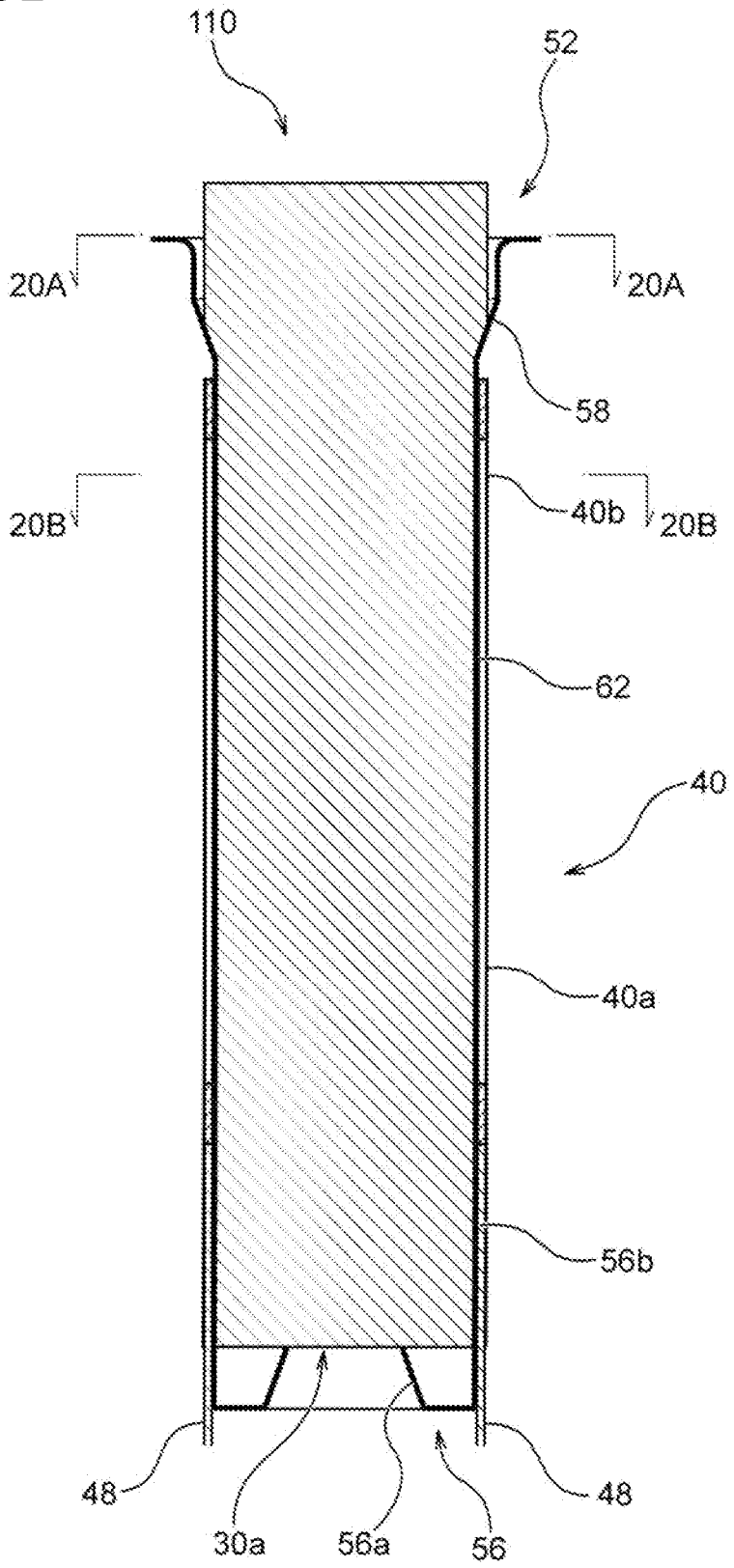
FIG. 19B is a longitudinal section of a chamber including a pressing unit according to the fourth embodiment, in which a consumable is positioned at a desired position in the chamber.
Figure 20A:
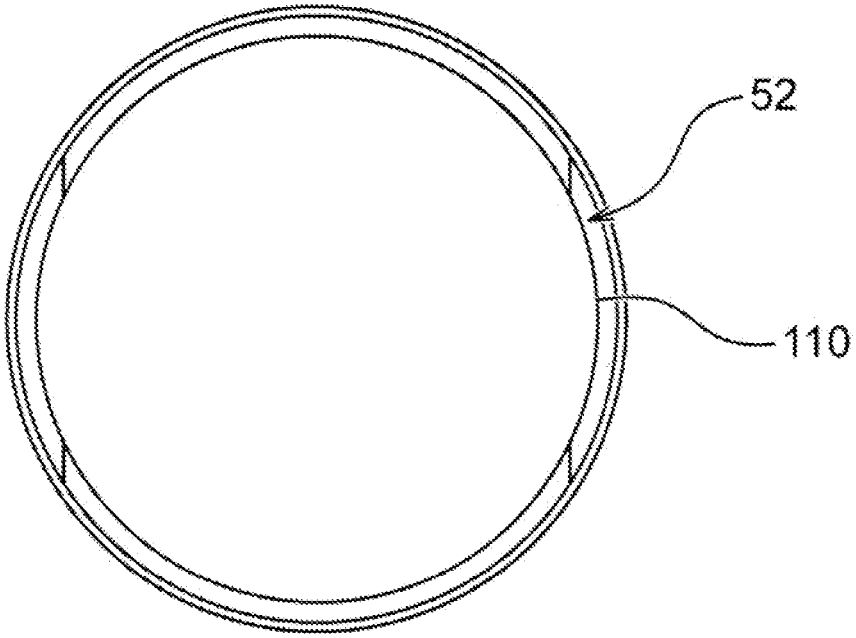
FIG. 20A is a cross section of the chamber taken along the arrow 23A-23A illustrated in FIG. 19B.
Figure 20B:
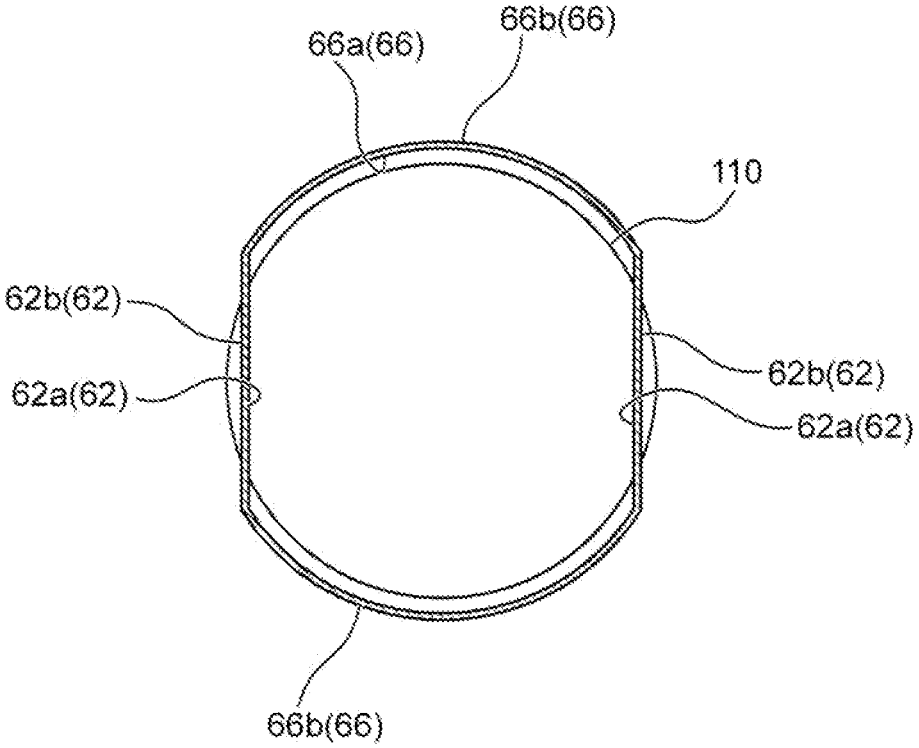
FIG. 20B is a cross section of the chamber taken along the arrow 23B-23B illustrated in FIG. 19B.

FIG. 19A is a longitudinal section of the chamber 50 including the non-pressing unit 66 according to the fourth embodiment, in which the consumable 110 is positioned at the desired position in the chamber 50. FIG. 19B is a longitudinal section of the chamber 50 including the pressing unit 62 according to the fourth embodiment, in which the consumable 110 is positioned at the desired position in the chamber 50. FIG. 20A is a cross section of the chamber 50 taken along the arrow 23A-23A illustrated in FIG. 19B. FIG. 20B is a cross section of the chamber 50 taken along the arrow 23B-23B illustrated in FIG. 19B. Note that in FIG. 20B, a cross section of the consumable 110 before being pressed is illustrated to make it easy to understand how the consumable 110 is pressed by the pressing units 62.

As illustrated in FIG. 19B, when the consumable 110 is positioned at the desired position in the chamber 50, the holding unit 60 is not substantially provided with a gap between the inner surface 66*a* of the non-pressing unit 66 and the consumable 110. Also, as illustrated in FIGS. 19A and 19B, an opening 30*a* for allowing air to flow into the chamber 50 is formed in the bottom wall 56*a* of the bottom unit 56 of the chamber 50.

The non-pressing unit 66 preferably touches the consumable 110 in a non-pressing state when the consumable 110 is placed inside the chamber 50. Here, a non-pressing state includes a substantially non-pressing state.

In the fourth embodiment, the inner circumferential length of the holding unit 60 is the same as the outer circumferential length of the consumable 110 before being pressed by the pressing unit 62. Note that herein, "the same" includes the case of being substantially the same.

As described above, the holding unit 60 includes the pressing unit 62 and the non-pressing unit 66. In the case where the inner circumferential length of the holding unit 60 and the outer circumferential length of the consumable 110 are substantially the same, a part of the consumable 110 is pressed by the pressing unit 62, thereby causing the outer circumferential shape of the consumable 110 to approximately match the inner cross-sectional shape of the holding unit 60. Compared to the case where the inner circumferential length and inner circumferential shape of the holding unit 60 are the same as the outer circumferential length and outer circumferential shape of the consumable 110, in the smoking system 100, a location is formed where the consumable 110 is pressed by the pressing unit 62, and therefore the efficiency of heat transfer from the heating unit 40 to the consumable 110 may be improved. Also, compared to the case where the outer circumferential length of the consumable 110 is shorter than the inner circumferential length of the holding unit 60, the inner circumferential surface (inner surface 66*a* of the non-pressing unit 66) of the holding unit 60 substantially touches the outer circumferential surface of the consumable 110 even in the locations where the consumable 110 is not being pressed, and therefore the efficiency of heat transfer from the heating unit 40 to the consumable 110 may be improved. Furthermore, compared to the case where the outer circumferential length of the consumable 110 is longer than the inner circumferential length of the holding unit 60, the consumable 110 can be inserted into the holding unit 60 smoothly, and strain caused by the outer circumferential surface of the consumable 110 and the density inside the consumable 110 (for example, tobacco) can be suppressed. As a result, it is possible to suppress uneven heating and inconsistencies in the draw resistance through each consumable 110, which may occur due to strain caused by the density inside the consumable 110.

Note that it may be said that, preferably, the inner circumferential length of the holding unit 60 is substantially the same as the outer circumferential length of the consumable 110 in the state of being pressed by the pressing unit 62, and the inner circumferential length of the holding unit 60 may be taken to be the inner circumferential length in the plane orthogonal to the longitudinal direction of the chamber 50 of the holding unit 60. Also, the "outer circumferential length of the consumable 110 before being pressed by the pressing unit 62" may be taken to be the outer circumferential length of the portion of the outer circumferential length of the consumable 110 before being pressed by the pressing unit 62 that is located at a position corresponding to the inner circumferential length of the holding unit 60 being compared to in the longitudinal direction of the chamber 50 when the consumable 110 is pressed by the pressing unit 62. Also, the "outer circumferential length of the consumable 110 in the state of being pressed by the pressing unit 62" may be taken to be the outer circumferential length of the portion of the outer circumferential length of the consumable 110 in the state of being pressed by the pressing unit 62 that is located at a position corresponding to the inner circumferential length of the holding unit 60 being compared to in the longitudinal direction of the chamber.

In the fourth embodiment, the inner circumferential length of the chamber 50 (holding unit 60) may also be the same as the outer circumferential length of the consumable 110 before being received into the chamber 50, and the inner circumferential shape of the chamber 50 (holding unit 60) in the plane orthogonal to the longitudinal direction of the chamber may also be different from the cross-sectional shape orthogonal to the longitudinal direction of the consumable 110 before the consumable 110 is received into the chamber 50. Herein, "the same" includes the case of being substantially the same.

According to the present embodiment, the consumable 110 is substantially close to the heating surface (the inner surface 62*a* of the pressing unit 62 of the chamber 50), and therefore heat from the heating unit 40 can be transferred to the consumable 110 efficiently. Specifically, since the inner circumferential length of the chamber 50 and the outer circumferential length of the consumable 110 are substantially the same and the inner circumferential shape of the chamber 50 is different from the cross-sectional shape of the consumable 110 to be received into the chamber 50, a part of the consumable 110 is pressed by the inner surface of the chamber 50, and the outer circumferential shape of the consumable 110 approximately matches the inner circumferential shape of the inner surface of the holding unit 60. Compared to the case where the inner circumferential length and inner circumferential shape of the chamber 50 are the same as the outer circumferential length and cross-sectional shape of the consumable 110, in the smoking system 100, a location is formed where the consumable 110 is pressed by the chamber 50, and therefore the efficiency of heat transfer from the heating unit 40 to the consumable 110 may be improved. Also, compared to the case where the outer circumferential length of the consumable 110 is shorter than the inner circumferential length of the chamber 50, the inner circumferential surface (non-pressing surface) of the chamber 50 substantially touches the outer circumferential surface of the consumable 110 even in the locations where the consumable 110 is not being pressed, and therefore the efficiency of heat transfer from the heating unit 40 to the consumable 110 may be improved. Furthermore, compared to the case where the outer circumferential length of the consumable 110 is longer than the inner circumferential length of the chamber 50, the consumable 110 can be inserted into the chamber 50 smoothly, and strain caused by the outer circumferential surface of the consumable 110 and the density inside the consumable 110 (for example, tobacco) can be suppressed. As a result, it is possible to suppress uneven heating and inconsistencies in the draw resistance through each consumable 110, which may occur due to strain caused by the density inside the consumable 110.

Also, it may be said that, preferably, the inner circumferential length of the chamber 50 is substantially the same as the outer circumferential length of the consumable 110 in the state of being pressed by the chamber 50, and the inner circumferential length of the chamber 50 may be taken to be the inner circumferential length in the plane orthogonal to the longitudinal direction of the chamber 50. Also, the "outer circumferential length of the consumable 110 before being received into the chamber 50" may be taken to be the outer circumferential length of the portion of the outer circumferential length of the consumable 110 before being received into the chamber 50 that is located at a position corresponding to the inner circumferential length of the chamber 50 being compared to in the longitudinal direction of the chamber 50 when the consumable 110 is received into the chamber 50. Also, the "outer circumferential length of the consumable 110 in the state of being pressed by the chamber 50" may be taken to be the outer circumferential length of the portion of the outer circumferential length of the consumable 110 in the state of being pressed by the chamber 50 that is located at a position corresponding to the inner circumferential length of the chamber 50 being compared to in the longitudinal direction of the chamber 50.

Fifth Embodiment

Figure 21:
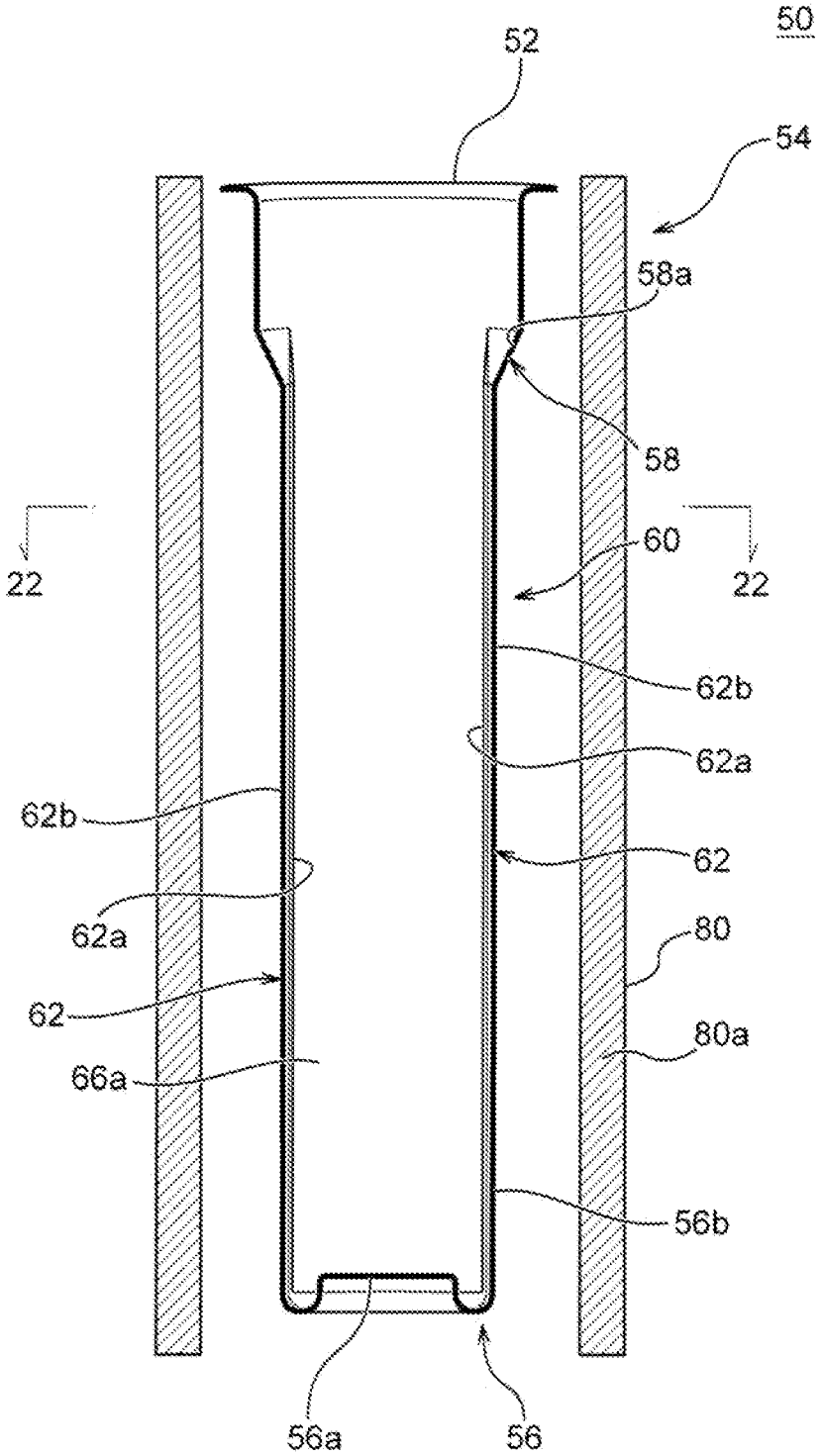
FIG. 21 is a diagrammatic cross section of a chamber and a sleeve provided in a device of a smoking system according to a fifth embodiment.
Figure 22:
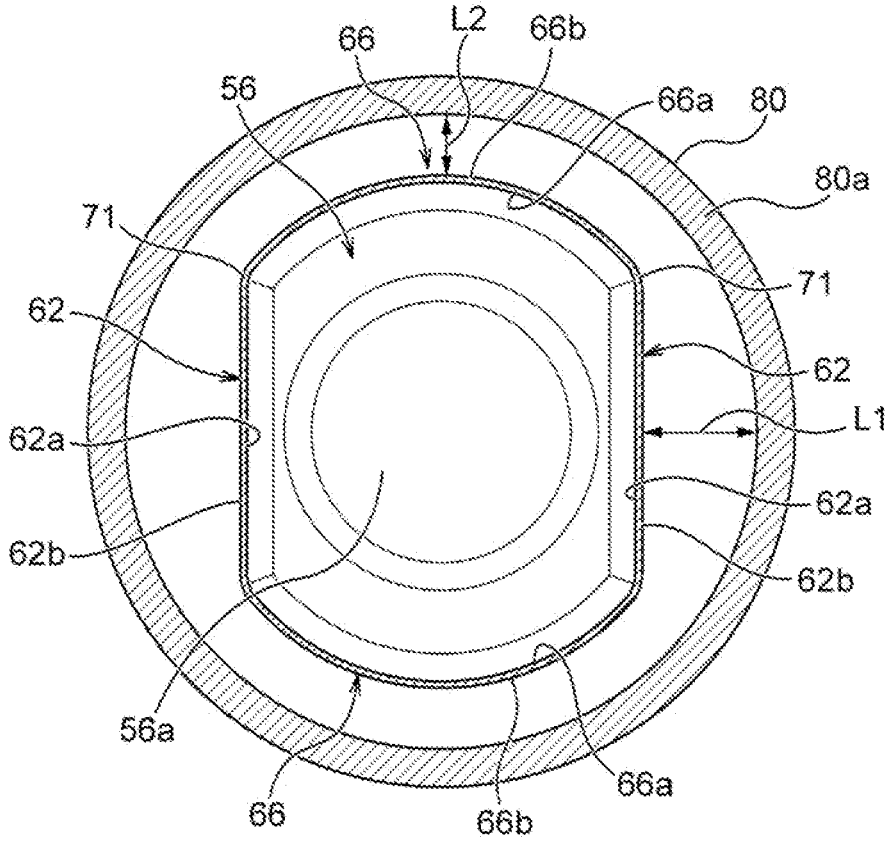
FIG. 22 is a diagrammatic cross section of the chamber and the sleeve taken along the arrow 22-22 illustrated in FIG. 21.

Next, a smoking system 100 according to a fifth embodiment will be described. The smoking system 100 of the fifth embodiment is different from the smoking system 100 of the first embodiment in that a tubular sleeve is provided around the chamber 50. FIG. 21 is a diagrammatic cross section of the chamber 50 and the sleeve provided in the device 120 of the smoking system 100 according to the fifth embodiment. FIG. 22 is a diagrammatic cross section of the chamber 50 and the sleeve taken along the arrow 22-22 illustrated in FIG. 21. As illustrated in FIGS. 21 and 22, in the smoking system 100 of the fifth embodiment, a tubular sleeve 80 surrounding the chamber 50 is provided. Note that the fifth embodiment may have the same structure and features as the smoking system 100 of the first embodiment, except for the sleeve 80.

As illustrated in FIG. 22, L1 is the shortest distance between the inner surface of the sleeve 80 and the outer surface 62*b* of the pressing unit 62 in the direction orthogonal direction to the longitudinal direction of the chamber 50. Note that the shortest distance here means the shortest distance between the inner surface of the sleeve 80 and any position on the outer surface 62*b* of the pressing unit 62. In the example illustrated in FIG. 22, the case where the shortest distance to the inner surface of the sleeve 80 is a maximum on the outer surface 62*b* of the pressing unit 62 is illustrated. Also, L2 is the shortest distance between the inner surface of the sleeve 80 and the outer surface 66*b* of the non-pressing unit 66 in the direction orthogonal direction to the longitudinal direction of the chamber 50. The shortest distance L1 is greater than the shortest distance L2. In other words, in the fifth embodiment, provided that, in the direction orthogonal to the longitudinal direction of the chamber 50, L1 is the shortest distance between the inner surface of the sleeve 80 and the outer surface 62*b* of the pressing unit 62 and L2 is the shortest distance between the inner surface of the sleeve 80 and the outer surface 66*b* of the non-pressing unit 66 of the chamber 50, L1 is greater than L2.

According to the fifth embodiment, by making the distance between the inner surface of the sleeve 80 and the outer surface 62*b* of the pressing unit 62 that presses a part of the consumable 110 longer compared to the non-pressing unit 66, the length (thickness) of the air layer in the gap is extended. As a result, when the consumable 110 is heated at the pressing unit 62, the heat-insulating efficiency of the air layer between the pressing unit 62 and the sleeve 80 can be improved. In particular, in the case where the heating unit 40 is disposed on the outer surface 62*b* of the pressing unit 62 as illustrated in FIG. 2, the pressing unit 62 contributes to the heating of the consumable 110 housed in the chamber 50 more than the non-pressing unit 66 that does not touch the consumable 110. Consequently, by increasing the distance between the outer surface 62*b* of the pressing unit 62 and the inner surface of the sleeve 80 compared to the non-pressing unit 66, the heat-insulating efficiency of the air layer between the pressing unit 62 and the sleeve 80 can be improved, and the consumable 110 may be heated efficiently.

As illustrated in FIGS. 21 and 22, the sleeve 80 preferably includes a heat-insulating unit 80*a*. In this case, the chamber 50 can be surrounded by the heat-insulating unit 80*a*, and therefore the transfer of heat from the heated consumable 110 to the outside of the device 120 may be suppressed. The heat-insulating unit 80*a* may be tubular, similarly to the sleeve 80. The heat-insulating unit 80*a* may be an air layer, a vacuum heat insulation layer, an aerogel, or some other heat-insulating material.

Although embodiments of the present invention have been described above, the present invention is not limited to the above embodiments, and various modifications are possible within the scope of the technical idea disclosed in the claims, specification, and drawings. Note that any shape or material not described directly in the specification and drawings is still within the scope of the technical idea of the present invention insofar as the actions and effects of the present application are exhibited. Moreover, shapes, degrees, or the like expressed as at least "substantially" in the specification are not intended to be limited only to "the shape, degree, or the like in a strict sense", but also include "shapes, degrees, or the like in a range within which at least the intended action is exhibited".

Now, some of aspects disclosed herein are described.

According to a first aspect of the present invention, a smoking system including a consumable containing a smokable substance and a device that heats and atomizes the smokable substance is provided. The device includes a chamber that receives the consumable and a heating unit that heats the consumable received into the chamber. The chamber includes an opening through which the consumable is inserted and a holding unit that holds the consumable. The holding unit includes a pressing unit, which presses a part of the consumable, and a non-pressing unit. The pressing unit and the non-pressing unit each have an inner surface and an outer surface. The heating unit is disposed on the outer surface of the pressing unit. The inner surface of the pressing unit may also be referred to as a pressing surface that presses the consumable, and the inner surface of the non-pressing unit may also be referred to as a non-pressing surface that does not press the consumable.

According to the first aspect, the consumable is substantially close to the heating surface (the inner surface of the pressing unit), and therefore heat from the heating unit can be transferred to the consumable efficiently. Note that the consumable contains a smokable substance, which includes tobacco and non-tobacco substances. The consumable may or may not include a mouthpiece. A consumable that includes a mouthpiece may be a stick-type consumable that resembles a conventional cigarette containing tobacco or the like as the smokable substance. A consumable that does not include a mouthpiece may be a consumable in which the smokable substance itself, such as tobacco, is compressed into a tablet shape or the like, or a consumable in which the smokable substance is wrapped in an air-permeable material such as non-woven cloth or a sheet material such as paper. In addition, the heating unit may also include a heating element. The chamber may be a bottomed cylindrical container or a cylindrical object with no bottom, for example. The chamber is preferably formed using a material such as a metal with high thermal conductivity, such as stainless steel. This configuration makes effective heating possible. The chamber walls are preferably of a uniform thickness (including the case where the thickness is substantially uniform). This configuration makes it possible to apply heat uniformly throughout the chamber. The thickness of the chamber is equal to or greater than 0.04 mm and less than or equal to 1.00 mm for example, preferably equal to or greater than 0.04 mm and less than or equal to 0.50 mm, more preferably equal to or greater than 0.05 mm and less than or equal to 0.10 mm.

The heating unit is preferably disposed with no gap to the outer surface of the pressing unit (with no gap between the outer surface of the pressing unit and the heating unit). Here, no gap is also taken to mean that there is substantially no gap. With this arrangement, the heating unit is close to the outer surface of the pressing unit, and therefore the heat from the heating unit can be transferred to the consumable even more efficiently. Note that the heating unit may also include an adhesive layer. In this case, the heating unit including the adhesive layer is preferably disposed with no gap to the outer surface of the pressing unit.

The opening preferably can receive the consumable without pressing. With this configuration, the consumable can be inserted into the chamber easily. The shape of the opening in the chamber in the plane orthogonal to the longitudinal direction of the chamber, or in other words, the direction in which the consumable is inserted into the chamber or the direction in which the sides of the chamber extend overall (hereinafter simply designated the longitudinal direction of the chamber), may be a polygonal shape or an elliptical shape, but preferably is circular. With this configuration, the consumable can be inserted into the opening easily.

The inner circumferential length of the holding unit is preferably the same as the outer circumferential length of the consumable before being pressed by the pressing unit. Note that herein, "the same" includes the case of being substantially the same. "Substantially the same" refers to a state in which the difference between the inner circumferential length of the holding unit and the outer circumferential length of the consumable before being pressed by the pressing unit is within ±6% of the inner circumferential length of the holding unit for example, preferably within ±4%, more preferably within ±2%. As described above, the holding unit includes the pressing unit and the non-pressing unit. In the case where the inner circumferential length of the holding unit and the outer circumferential length of the consumable are substantially the same, a part of the consumable is pressed by the pressing unit, thereby causing the outer circumferential shape of the consumable to approximately match the inner cross-sectional shape of the holding unit. Compared to the case where the inner circumferential length and inner circumferential shape of the holding unit are the same as the outer circumferential length and outer circumferential shape of the consumable, in this smoking system, a location is formed where the consumable is pressed by the pressing unit, and therefore the efficiency of heat transfer from the heating unit to the consumable may be improved. Also, compared to the case where the outer circumferential length of the consumable is shorter than the inner circumferential length of the holding unit, the inner circumferential surface (non-pressing surface) of the holding unit substantially touches the outer circumferential surface of the consumable even in the locations where the consumable is not being pressed, and therefore the efficiency of heat transfer from the heating unit to the consumable may be improved. Furthermore, compared to the case where the outer circumferential length of the consumable is longer than the inner circumferential length of the holding unit, the consumable can be inserted into the holding unit smoothly, and strain caused by the outer circumferential surface of the consumable and the density inside the consumable (for instance, tobacco as one example of a smokable substance) can be suppressed. As a result, it is possible to suppress uneven heating and inconsistencies in the draw resistance through each consumable, which may occur due to strain caused by the density inside the consumable. Also, it may be said that, preferably, the inner circumferential length of the holding unit is substantially the same as the outer circumferential length of the consumable in the state of being pressed by the pressing unit, and the inner circumferential length of the holding unit may be taken to be the inner circumferential length in the plane orthogonal to the longitudinal direction of the chamber of the holding unit. Also, the "outer circumferential length of the consumable before being pressed by the pressing unit" may be taken to be the outer circumferential length of the portion of the outer circumferential length of the consumable before being pressed by the pressing unit that is located at a position corresponding to the inner circumferential length of the holding unit being compared to in the longitudinal direction of the chamber when the consumable is pressed by the pressing unit. Also, the "outer circumferential length of the consumable in the state of being pressed by the pressing unit" may be taken to be the outer circumferential length of the portion of the outer circumferential length of the consumable in the state of being pressed by the pressing unit that is located at a position corresponding to the inner circumferential length of the holding unit being compared to in the longitudinal direction of the chamber.

The outer circumferential surface of the holding unit preferably has the same shape and size (outer circumferential length of the holding unit in the plane orthogonal to the longitudinal direction of the chamber) throughout the entire length of the chamber in the longitudinal direction. This arrangement makes it possible to keep the heating unit from being provided loosely on the outer surface of the pressing unit of the holding unit, and as a result, the heating unit can be provided easily with substantially no gap to the outer surface of the pressing unit.

The non-pressing unit preferably touches the consumable in a non-pressing state when the consumable is placed at a desired position inside the chamber. Here, a non-pressing state includes a substantially non-pressing state. With this arrangement, a gap is not substantially created between the consumable and the holding unit, and therefore the efficiency of heat transfer from the heating unit to the consumable may be improved further in the non-pressing unit, too. The non-pressing unit has an inner surface that connects to the pressing unit of which the opposing inner surface is flat, and the inner surface of the non-pressing unit may also be curved.

The inner surface of the non-pressing unit of the holding unit preferably has a curved surface connecting the ends of the inner surface of the pressing unit in the circumferential direction of the chamber. With this arrangement, the structure of the smoking system can be simplified, and moreover, the non-pressing unit can be cleaned more easily compared to the case where the inner surface has corners, for instance. In the case where an air gap described later is formed inside the chamber, the air gap can be cleaned more easily compared to the case where the inner surface has corners, for instance. The shape of the inner surface of the non-pressing unit in the plane orthogonal to the longitudinal direction of the chamber is preferably the same as the shape of the opening in the plane orthogonal to the longitudinal direction of the chamber at any position in the longitudinal direction of the chamber. In other words, the inner surface of the non-pressing unit preferably is formed such that the inner surface of the chamber that forms the opening extends in the longitudinal direction. With this arrangement, the configuration of the chamber can be simplified, and in the case where the air gap described later is formed inside the chamber, the flow of air coming in from the opening in the chamber is less obstructed. Furthermore, the air gap can be cleaned more easily. Note that the "circumferential direction of the chamber" may also be thought of as the "rotational direction of the chamber about the longitudinal axis".

The outer surface of the pressing unit may be a curved or uneven surface, but preferably is a flat surface. Note that herein, a "flat surface" includes the case of a substantially flat surface. From the perspective of the ratio of the flatness of the pressing unit with respect to the entire outer surface, the state in which "the outer surface of the pressing unit is substantially flat" refers to a state in which the ratio of the flatness of the pressing unit with respect to the entire outer surface is 80% or higher for example, preferably 90% or higher, more preferably 95% or higher.

Since the outer surface of the pressing unit is a flat surface, when band-shaped electrodes are connected to the heating unit disposed on the outer surface of the pressing unit, bending of the band-shaped electrodes can be suppressed, thereby making it easier to lay out electrodes inside the device. In addition, compared to the case where the outer surface of the pressing unit is a curved or uneven surface, the heating unit can be positioned accurately and disposed easily without a gap to the outer surface of the pressing unit.

The inner surface of the pressing unit is preferably a flat surface. This configuration makes it easier to insert the consumable. Here, a "flat surface" also includes the case of a substantially flat surface. Also, the pressing unit is preferably of a uniform thickness. With this configuration, more uniform heating can be applied. Here, a "uniform thickness" also includes the case where the thickness is substantially uniform. The thickness of the pressing unit is equal to or greater than 0.04 mm and less than or equal to 1.00 mm for example, preferably equal to or greater than 0.04 mm and less than or equal to 0.50 mm, more preferably equal to or greater than 0.05 mm and less than or equal to 0.10 mm. With this configuration, hindrances to the efficient transfer of heat to the consumable due to an overly large volume of the pressing unit can be suppressed, and a sufficiently strong pressing unit may be secured.

In the case where the inner surface of the pressing unit is a flat surface, the chamber may have only a single pressing unit, but preferably the chamber has two or more pressing units in the circumferential direction. With this arrangement, the consumable is pressed at two or more locations in the circumferential direction of the chamber, and therefore the consumable can be heated comprehensively and uniformly.

The holding unit includes two pressing units facing each other, and at least a portion of the distance between the inner surfaces of the two pressing units is preferably shorter than the width of the consumable inserted into the chamber at the location disposed between the pressing units. The inner surfaces of the two pressing units facing each other of the holding unit may be flat surfaces.

In the case where the inner surfaces of the pressing units are flat surfaces, three or more pressing units may exist in the circumferential direction. The pressing units may be disposed so as to face each other, but may also be disposed to face each of the non-pressing units. In the case of being disposed to face each of the non-pressing units, the distance between the point where the lines extending perpendicularly from the center of the inner surface of each pressing unit intersect and the center of the inner surface of each pressing unit in the plane orthogonal to the longitudinal direction of the chamber may be shorter than the radius of the inserted consumable having a circular cross section. Here, "circular" also includes a substantially circular shape.

The inner surfaces of the pressing units preferably have pairs of flat pressing surfaces having a planar shape and facing each other, and the inner surfaces of the non-pressing units preferably have pairs of curved non-pressing surfaces having a curved shape and facing each other that connect the ends of the pairs of flat pressing surfaces. The curved non-pressing surfaces may have an arc-like cross section overall in the plane orthogonal to the longitudinal direction of the chamber. The holding unit may be configured by a cylindrical metal object of uniform thickness. Here, a uniform thickness includes a substantially uniform thickness. This configuration simplifies the chamber structure and makes high-precision manufacturing easy. Also, with this configuration, the positions of the pressing units and non-pressing units can be arranged in a balanced way to achieve uniform heating, making it easier to dispose the heating unit on the outer surface of the pressing unit with good positional accuracy and also without a gap, thereby improving the heating efficiency. The thickness of the holding unit is equal to or greater than 0.04 mm and less than or equal to 1.00 mm for example, preferably equal to or greater than 0.04 mm and less than or equal to 0.50 mm, more preferably equal to or greater than 0.05 mm and less than or equal to 0.10 mm. With this configuration, hindrances to the efficient transfer of heat to the consumable due to an overly large volume of the holding unit can be suppressed, and a sufficiently strong holding unit may be secured.

The holding unit may also be provided with an air gap between the inner surface of the non-pressing unit and the consumable when the consumable is positioned at a desired position in the chamber, the air gap connecting the opening in the chamber and the end surface of the consumable positioned at the desired position in the chamber, or the opening in the chamber and the end surface of the consumable positioned inside the chamber and away from the opening in the chamber. The air gap is a channel that allows air to flow from the opening in the chamber to the end surface of the consumable when the user inhales, and since it is not necessary to provide the smoking system with a separate channel for introducing air to be supplied to the consumable, the structure of the smoking system can be simplified, and furthermore, since the location where a part of the air gap is formed in the non-pressing unit is exposed, the air gap can be cleaned easily. In addition, the air passing through the air gap can be heated efficiently, and the thermal energy from the heating unit can be used effectively. From the perspective of factors such as draw resistance, the height of the air gap (the magnitude of the longest distance between the inner surface of the non-pressing unit and the consumable on the line extending radially outward from the cross-sectional center of the consumable positioned at the desired position in the chamber) is preferably equal to or greater than 0.1 mm and less than or equal to 1.0 mm, more preferably equal to or greater than 0.2 mm and less than or equal to 0.8 mm, most preferably equal to or greater than 0.3 mm and less than or equal to 0.5 mm.

For example, when the holding unit has at least two pressing units spaced out circumferentially around the chamber and the consumable is positioned at a desired position in the chamber, the holding unit preferably is provided with an air gap between the inner surface of the non-pressing unit connecting the two pressing units and the consumable, the air gap connecting the opening in the chamber and the end surface of the consumable positioned at the desired position in the chamber, or the opening in the chamber and the end surface of the consumable positioned inside the chamber and away from the opening in the chamber. More preferably, there are two air gaps provided between the inner surfaces of two non-pressing units connecting two pressing units and the consumable. Even more preferably, there are three or more air gaps provided between the inner surfaces of three or more non-pressing units connecting three or more pressing units and the consumable. With this arrangement, unbalanced air flow inside the chamber can be suppressed further, and hindrances to more uniform heating can be suppressed.

The two pressing units preferably face each other. In this case, unbalanced air flow inside the chamber can be suppressed further, and hindrances to more uniform heating can be suppressed further. Additionally, the two pressing units preferably are parallel to each other. In this case, since the consumable is pressed by the two pressing units facing each other in parallel, the consumable can be heated evenly from either side of the consumable, and an aerosol can be generated efficiently.

The holding unit preferably does not have a raised part on the inner surface thereof. If the inner surface of the holding unit of uniform thickness has a raised part, it may be difficult to dispose the heating unit on the outer surface of the pressing unit without a gap in the case where a recessed part is formed on the outer surface of the holding unit. Moreover, if there is a raised part on the inner surface of the holding unit, the thickness of the holding unit becomes non-uniform, which may hinder more uniform heating. However, the above issues may be avoided if the holding unit does not have a raised part on the inner surface thereof.

The chamber preferably has a first guide unit provided with a tapered surface that connects the inner surface of the chamber forming the opening to the inner surface of the pressing unit. The first guide unit can be used to change the cross-sectional shape of the inner surface of the chamber continuously from the opening to the pressing unit, thereby making it possible to insert the consumable into the chamber smoothly. Preferably, the heating unit is not disposed on at least one selected from the group consisting of the outer surface of the chamber between the opening and the first guide unit, the outer surface of the first guide unit, and the outer surface of the non-pressing unit. The inner surface corresponding to the above outer surfaces does not press the consumable, and therefore by not providing the heating unit on these outer surfaces, energy can be used for heating efficiently.

The chamber preferably is provided with a cylindrical non-holding unit between the opening and the holding unit. In the state with the consumable positioned at the desired position in the chamber, the gap between the inner surface of the non-pressing unit and the consumable is less than or equal to 3.0 mm for example, preferably less than or equal to 1.0 mm, more preferably less than or equal to 0.5 mm and equal to or greater than 0.4 mm. If the gap is in the above range, the consumable can be heated efficiently through the non-holding unit, and the condensation of the aerosol passing through the interior of the consumable can be suppressed. Also, when the above gap exists, the air passing through the gap can be heated efficiently, and the thermal energy from the heating unit can be used effectively. Furthermore, by setting the gap equal to or greater than 0.4 mm, the consumable is easy to insert into the chamber. Note that in this specification, the "state with the consumable positioned at the desired position in the chamber" refers to a state in which the consumable is positioned correctly at the intended position inside the chamber for generating an aerosol from the consumable (for example, in the case where the chamber has "a bottom unit abutted by the inserted consumable", the state in which the bottom unit is abutted by at least a part of the consumable, or in the case where the device includes an "abutting unit abutted by the inserted consumable" on the inside or the outside of the chamber, the state in which the consumable abuts at least a part of the abutting unit").

The chamber may include a bottom unit. Alternatively, the device may include, on the inside or the outside of the chamber, an abutting unit abutted by the consumable inserted into the chamber. The bottom unit or the abutting unit preferably supports a part of the consumable positioned at the desired position in the chamber such that at least a part of the end surface of the consumable is exposed. Also, in the case where the smoking system has the air gap described above, the bottom unit or the abutting unit preferably supports a part of the consumable such that the exposed end surface of the consumable is connected to the air gap. With this arrangement, air can be drawn in from the end surface of the consumable, and furthermore, the consumable can be positioned in the longitudinal direction. The bottom unit of the chamber includes a bottom wall and side walls, and the width of the bottom unit demarcated by the side walls may decrease toward the bottom wall. With this configuration, when the consumable inserted into the chamber arrives at the bottom unit, the consumable is compressed by the side walls and thereby positioned. The bottom unit or the abutting unit of the chamber includes a bottom wall or an abutting surface, and the bottom wall or the abutting unit may also include a raised part or a grooved part. Also, the bottom unit or the abutting unit of the chamber includes a bottom wall or an abutting surface, and the bottom wall or the abutting surface may also include a hole for drawing air into the chamber.

The chamber may also include a cylindrical member having an opening in at least one end. The heating unit may be configured to start heating at the same time for all pressing units, or to perform heating in the same time period.

The heating unit preferably is disposed over the entire outer surface of the pressing unit. With this arrangement, more uniform heat transfer from the heating unit to the pressing unit can be achieved, and as a result, the consumable held by the holding unit can be heated efficiently.

The device may also include band-shaped electrodes extending from the heating unit. Since the electrodes are band-shaped, the reliability of power supply to the heating unit can be improved compared to string-shaped electrodes. The band-shaped electrodes preferably extend from the flat outer surface of the pressing unit to the outside of the outer surface of the pressing unit in a state with the heating unit disposed on the outer surface of the pressing unit. As described above, since the outer surface of the pressing unit is a flat surface, bending of the band-shaped electrodes can be suppressed, thereby making it easier to lay out electrodes inside the device.

The band-shaped electrodes may extend from the outer surface of only one of the two pressing units. In this case, the band-shaped electrodes can be bundled together, and a more compact device can be attained. Also, the band-shaped electrodes may extend from the outer surface of each of the two pressing units. In this case, a plurality of independent heating units can be provided by the respective band-shaped electrodes, or the positive and negative electrodes can be laid out separately according to the arrangement of parts in the device. The band-shaped electrodes may also extend toward the opposite side away from the opening side of the chamber. In this case, since the electrodes are not disposed on the opening side of the chamber where the consumable is inserted, the device can be given a simple structure and the reliability of the device may be improved. The band-shaped electrodes may also have a structure in which layers containing conductive tracks are arranged between two layers containing an electrical insulation material. The electrical insulation material is a polyimide for example, and the conductive tracks may be formed using a material such as gold, silver, copper, nickel, an alloy thereof, or a combination of a plurality of the above metals or alloys thereof, for example. With this configuration, a flexible heating structure that is easy to manufacture and also highly reliable is obtained.

The heating unit preferably includes a heating element and an electrical insulation member that covers at least one surface of the heating element. In addition, the electrical insulation member preferably is disposed inside the region of the outer surface of the holding unit. In other words, the electrical insulation member preferably is disposed so as not to stick out from the outer surface of the holding unit on the first guide unit side of the chamber in the longitudinal direction. As described above, in the case where the first guide unit is provided between the opening and the pressing unit, the shape of the outer surface of the chamber and the outer circumferential length of the chamber in the plane orthogonal to the longitudinal direction of the chamber may vary between the first guide unit and the holding unit. For this reason, by disposing the electrical insulation member only on the outer surface of the holding unit, it is possible to keep slack from occurring.

Furthermore, the device preferably is provided with a sheet (securing sheet) that covers the chamber and the heating unit and secures the heating unit to the outer surface of the chamber. One example of the sheet for securing the heating unit is a shrinking sheet that shrinks in response to some kind of external action, more specifically a heat-shrinking sheet or the like that shrinks when heat is applied. Preferably, the securing sheet such as a shrinking sheet has a shrinkage factor that is higher in the circumferential direction than the longitudinal direction of the chamber in the state in which the securing sheet is covering the chamber and the heating unit. The heat-shrinking sheet may also contain a material such as a polyimide, polypropylene, polyethylene terephthalate, gelatin, or a polysaccharide. With the securing sheet, the heating unit can be secured firmly and closely onto the outer surface of the chamber, thereby raising the heating efficiency further and stabilizing the structure around the chamber. Additionally, the sheet preferably is disposed on the outer surface of the holding unit. In other words, the sheet preferably is disposed so as not to stick out from over the outer surface of the holding unit on the first guide unit side of the chamber in the longitudinal direction. As described above, in the case where the first guide unit is provided between the opening and the holding unit, the shape of the outer surface of the chamber and the outer circumferential length of the chamber in the plane orthogonal to the longitudinal direction of the chamber may vary between the first guide unit and the holding unit. For this reason, by disposing the sheet only on the outer surface of the holding unit, it is possible to keep slack from occurring.

The heating unit may also include a first portion positioned on the opposite side from the opening and a second portion positioned on the opening side. The heater power density in the second portion preferably is higher than the heater power density in the first portion, or the rate of temperature increase in the second portion preferably is higher than the rate of temperature increase in the first portion, or the heating temperature in the second portion preferably is higher than the heating temperature in the first portion over any equal time. In the state in which the consumable is positioned at the desired position in the chamber, the second portion preferably covers the outer surface of the holding unit corresponding to at least ½ the smokable substance included in the consumable in the longitudinal direction of the smokable substance. This arrangement makes it possible to shorten the time from when the heating unit is activated until the first puff can be taken, while also reducing energy consumption.

In the state in which the consumable is positioned at the desired position in the chamber, the upstream (upstream in the direction in which air and the aerosol flow when the user inhales; the same applies hereinafter) end of the heating unit or the heating element disposed on the outer surface of the pressing unit preferably is positioned farther downstream (downstream in the direction in which air and the aerosol flow when the user inhales; the same applies hereinafter) than the upstream end of the smokable substance in the consumable. For example, the upstream end of the heating unit or the heating element is positioned equal to or greater than 1.0 mm and less than or equal to 10.0 mm farther downstream than the upstream end of the smokable substance in the consumable positioned at the desired position in the chamber, preferably positioned equal to or greater than 3.0 mm and less than or equal to 6.0 mm farther downstream, more preferably positioned equal to or greater than 4.5 mm and less than or equal to 5.5 mm farther downstream. This arrangement makes it possible to keep the aerosol from flowing out from the upstream end of the smokable substance. Moreover, the above arrangement may have a positive effect on taste.

In the state in which the consumable is positioned at the desired position in the chamber, the downstream end of the heating unit or the heating element disposed on the outer surface of the pressing unit preferably is positioned farther downstream than the downstream end of the smokable substance in the consumable. For example, the downstream end of the heating unit or the heating element is positioned equal to or greater than 1.0 mm and less than or equal to 10.0 mm farther downstream than the downstream end of the smokable substance in the consumable positioned at the desired position in the chamber, preferably positioned equal to or greater than 2.0 mm and less than or equal to 5.0 mm farther downstream, more preferably positioned equal to or greater than 2.0 mm and less than or equal to 3.0 mm farther downstream. This arrangement makes it possible to keep the aerosol from condensing, while also reducing energy consumption.

The heater power density of the heating unit disposed on the outer surface of the pressing unit preferably is higher than the heater power density of the heating unit covering the outer surface of the non-pressing unit, or the rate of temperature increase of the heating unit disposed on the outer surface of the pressing unit preferably is higher than the rate of temperature increase of the heating unit covering the outer surface of the non-pressing unit, or the heating temperature of the heating unit disposed on the outer surface of the pressing unit preferably is higher than the heating temperature of the heating unit disposed on the outer surface of the non-pressing unit over any equal time. According to this configuration, the smokable substance can be heated more efficiently in the case where the range of the pressing unit in the holding unit is equal to or greater than a certain range with respect to the area of the non-pressing unit. The heater power density of the heating unit disposed on the outer surface of the pressing unit may also be the same as the heater power density of the heating unit covering the outer surface of the non-pressing unit. The rate of temperature increase of the heating unit disposed on the outer surface of the pressing unit may also be the same as the rate of temperature increase of the heating unit covering the outer surface of the non-pressing unit. The heating temperature of the heating unit disposed on the outer surface of the pressing unit may also be the same as the heating temperature of the heating unit covering the outer surface of the non-pressing unit. Note that herein, "the same" includes the case of being substantially the same.

The heating unit may include a heating element, and the heating element may be a heating track. The outer surface of the pressing unit and the outer surface of the non-pressing unit may be connected to one another at an angle, and a boundary may be formed between the outer surface of the pressing unit and the outer surface of the non-pressing unit. The heating track preferably extends only in a direction crossing the direction in which the boundary extends, more preferably in the direction at a right angle to the direction in which the boundary extends. With this arrangement, the heating track is damaged less readily and also peels away from the outer surface of the holding unit less readily. Note that herein, the "direction at a right angle" also includes the case of a direction substantially at a right angle.

The heating unit may be a sheet heater, for example. The sheet heater may have a structure in which a layer containing an electrical insulation material and a layer containing a heating track as one example of the heating element are stacked. As another example, the heating unit may have a structure in which a layer containing a heating track is disposed between two layers containing an electrical insulation material. The electrical insulation material may be a polyimide for example, and the heating track may be a metal such as stainless steel for example. With this configuration, a flexible heating structure that is easy to manufacture and also highly reliable is obtained.

The consumable includes a first portion having a first hardness and a second portion having a second hardness, in which the second portion is a different portion from the first portion in the insertion direction of the consumable, and the first portion may be disposed closer to the longitudinal end of the consumable than the second portion.

When the consumable is positioned at the desired position in the chamber, the consumable preferably is positioned such that at least a part of the first portion is pressed against the inner surface of the pressing unit. Also, the first hardness is equal to or greater than 65% and less than or equal to 90% for example, preferably equal to or greater than 70% and less than or equal to 85%, more preferably equal to or greater than 73% and less than or equal to 82%, most preferably equal to or greater than 77% and less than or equal to 81%. With this configuration, the consumable retains its shape more easily, and the consumable is easier to insert into the holding unit.

When the consumable is positioned at the desired position in the chamber, the consumable preferably is positioned such that at least a part of the second portion is pressed against the inner surface of the pressing unit. Also, the second hardness is equal to or greater than 90% and less than or equal to 99% for example, preferably equal to or greater than 90% and less than or equal to 99%, more preferably equal to or greater than 92% and less than or equal to 98%, most preferably equal to or greater than 95% and less than or equal to 98%. With this arrangement, insertion is performed easily and the consumable is held firmly.

The second hardness preferably is higher than the first hardness. According to this configuration, easy insertion of the consumable into the holding unit and firm holding of the consumable may be achieved at the same time. Also, by changing from the state in which only the first portion is pressed against the inner surface of the pressing unit to the state in which the second portion is also pressed against the inner surface of the pressing unit when the consumable is inserted into the chamber, the user can feel a change in resistance when inserting the consumable. As a result, during insertion the user can know how far the consumable has been inserted into the chamber and use this information as a clue for learning how much farther the consumable should be inserted to reach the desired insertion position, thereby making it easier to position the consumable at the desired position. The first portion and the second portion preferably are disposed adjacently so that the user can clearly feel the change in resistance. Also, the difference between the first hardness and the second hardness is preferably at least equal to or greater than 4%, more preferably equal to or greater than 10%, most preferably equal to or greater than 14%.

The term "hardness" as used throughout this specification means resistance against deformation. Hardness is generally expressed as a ratio. In the case where the consumable is a cylindrical stick, provided that $D_s$ is the diameter of the consumable before a load is imposed and $D_d$ is the diameter of the consumable in the direction in which a predetermined load is imposed when the load is imposed in the diameter direction, the deformation d of the consumable when the predetermined load is imposed can be expressed as $D_s-D_d$. In this case, the hardness (%) is expressed by $D_d/D_s\times100$ (%). The harder the material forming the consumable is, the more the hardness approaches 100%.

To measure $D_d$, the device sold under the product name Hardness Tester H10 (Borgwaldt KC GmbH, Hamburg, Germany) is used under conditions of an ambient temperature in the range of 22±2 degrees Celsius and 60% relative humidity in accordance with ISO 187 to measure a load of 88 grams imposed for 5 seconds.

Preferably, the length of the first portion of the consumable in the longitudinal direction is less than or equal to the length of the inner surface of the pressing unit in the longitudinal direction, and when the consumable is positioned at the desired position in the chamber, the consumable is positioned in the chamber such that the first portion of the consumable does not stick out from the inner surface of the pressing unit in the longitudinal direction. With this arrangement, in the case where the smokable substance is included in the first portion, the smokable substance is pressed throughout the entire length in the longitudinal direction, thereby heating and atomizing the entire smokable substance efficiently. Also, when the consumable is positioned at the desired position in the chamber, the entire outer circumferential surface of the smokable substance of the consumable preferably is covered by the holding unit. With this arrangement, the entire outer circumferential surface of the smokable substance is heated directly by the holding unit, and therefore the smokable substance can be heated uniformly and efficiently. Also, when the consumable is positioned at the desired position in the chamber, the consumable preferably is positioned such that at least a part of the first portion is pressed against the inner surface of the pressing unit, while at the same time, at least a part of the second portion is pressed against the inner surface of the pressing unit. With this arrangement, in the case where the smokable substance is included in the first portion, efficient heating of the smokable substance and firm holding of the consumable may be achieved by the pressing unit at the same time.

The distance over which the second portion of the consumable is inserted into the holding unit when the consumable is positioned at the desired position is preferably equal to or greater than 1.0 mm and less than or equal to 10.0 mm, more preferably equal to or greater than 2.0 mm and less than or equal to 8.0 mm, most preferably equal to or greater than 4.0 mm and less than or equal to 6.0 mm. With this arrangement, the securing of an appropriate holding force for the consumable and the ease of insertion of the consumable may be achieved at the same time.

The chamber may also have a bottom unit or an abutting unit. The length of the bottom unit or the abutting unit of the chamber from the bottom wall or abutting surface abutted by the consumable to the end on the opening side of the pressing unit is longer than the length of the first portion of the consumable in the longitudinal direction (hereinafter referred to as the length of the first portion), and is also preferably shorter than 1.5 times the length of the first portion, more preferably shorter than 1.35 times. Additionally/alternatively, when the consumable is positioned at the desired position in the chamber, at least a part of the first portion of the consumable preferably is positioned closer to the opening than a central part of the holding unit in the longitudinal direction. With this arrangement, a change in resistance can be felt before the first portion of the consumable abuts the bottom wall or abutting surface of the chamber, and since the insertion position where the change is felt can be set to a position relatively close to the desired insertion position of the consumable, the consumable is positioned at the desired position more easily, and the feel of using the device may be improved for the user.

The first portion preferably includes a smokable substance containing tobacco as one example of a flavor source. In addition, the first portion may include an air-permeable sheet member wrapped around the smokable substance and a lid which is secured to the sheet member and which prevents the smokable substance from falling out. The lid is air-permeable and may be attached to the sheet member using glue, for example. The lid may also be secured to the sheet member by frictional force. The lid may be a paper filter or an acetate filter, for example. The second portion may include a cylindrical member. The cylindrical member may be a paper tube or a hollow filter.

The hollow filter may be configured using a packing layer including one or multiple hollow channels and a plug wrapper that covers the packing layer. Since the fibers in the packing layer have a high packing density, during inhalation, the air and the aerosol only flow through the hollow channel(s), and there is little or no flow inside the packing layer. The hollow filter may also include a mouthpiece configured using an adjacent filter unit or the like. In the consumable, when it is desirable to lessen the reduction of the aerosol component due to filtration through the filter unit, shortening the length of the filter unit and replacing the shortened length with the hollow filter unit is effective at increasing the quantity of delivered aerosol.

The consumable may also include a first wrap paper wrapped around the smokable substance. The length of the consumable in the longitudinal direction is preferably 40 mm to 90 mm, more preferably 50 mm to 75 mm, even more preferably 50 mm to 60 mm. The circumferential length of the consumable is preferably 15 mm to 25 mm, more preferably 17 mm to 24 mm, even more preferably 20 mm to 23 mm. Also, the length of the smokable substance in the consumable may be 18 mm to 22 mm, the length of the first wrap paper may be 18 mm to 22 mm, the length of the hollow filter unit may be 7 mm to 9 mm, and the length of the filter unit may be 6 mm to 8 mm.

The smokable substance in the consumable may include an aerosol source that generates an aerosol when heated to a predetermined temperature. The type of the aerosol source is not particularly limited, and extracts and/or their components from any of various types of natural substances may be selected according to the purpose. Examples of the aerosol source include glycerin, propylene glycol, triacetin, 1,3-butanediol, and mixtures thereof. The quantity of the aerosol source included in the smokable substance (percent by weight with respect to the total weight of the smokable substance) is not particularly limited, but from the perspective of generating sufficient aerosol and also imparting a pleasant inhaled flavor, the quantity is normally equal to or greater than 5% by weight, preferably equal to or greater than 10% by weight, and furthermore, is normally less than or equal to 50% by weight, preferably less than or equal to 20% by weight.

For the smokable substance in the consumable, tobacco such as the lamina, midrib, or other known plant material may be used as a flavor source. Additionally, the flavor source such as tobacco may be shaped into cuttings, sheets, strings, a powder, granules, pellets, a slurry, a porous shape, or the like. In the case where the smokable substance has a circumferential length from 20 mm to 23 mm and a length from 18 mm to 22 mm, the quantity range of the smokable substance such as tobacco contained in the consumable may be from 200 mg to 400 mg for example, preferably from 250 mg to 320 mg. The moisture content of the smokable substance such as tobacco (percent by weight with respect to the total weight of the smokable substance) is 8% to 18% by weight for example, preferably 10% to 16% by weight. When such moisture content is present, roll staining is suppressed and favorable rollability during manufacturing is achieved. Moreover, the consumable is more easily deformed suitably to match the cross-sectional shape of the holding unit. The size and preparation method of the cut tobacco used as one example of the smokable substance are not particularly limited. For example, dried tobacco leaf that has been cut into pieces having a width from 0.8 mm to 1.2 mm may be used. Also, dried tobacco leaf may be pulverized such that the average particle size is approximately from 20 μm to 200 μm, and then uniform particles thereof may be worked into sheets and cut into pieces having a width from 0.8 mm to 1.2 mm and used. Furthermore, a product obtained by gathering the sheets worked as above without cutting may also be used as the smokable substance. The smokable substance may also include one or multiple aromatic substances. The type of the aromatic substance is not particularly limited, but menthol is preferable from the perspective of imparting a pleasant inhaled flavor.

The consumable may also include a second wrap paper which is different from the first wrap paper and which is used to wrap at least one of the cylindrical member, the hollow filter unit, and the filter unit. The second wrap paper may also wrap a part of the first wrap paper used to wrap the smokable substance. The first wrap paper and the second wrap paper of the consumable can be made from a base paper having a basis weight from 20 gsm to 65 gsm, for example. The thickness of the first wrap paper and the second wrap paper is not particularly limited, but from the perspective of rigidity, air permeability, and ease of adjustment during papermaking, is normally from 10 μm to 100 μm.

A loading material may be included in the first wrap paper and the second wrap paper of the consumable. The loading material content may be from 10% to 60% by weight with respect to the total weight of the first wrap paper and the second wrap paper, preferably from 15% to 45% by weight. In the present embodiment, the loading material preferably is from 15% to 45% by weight with respect to the preferable basis weight range (25 gsm to 45 gsm). For the loading material, calcium carbonate, titanium dioxide, kaolin, or the like can be used, for example. Paper including such a loading material presents a bright white color that is preferable from the perspective of appearance for use as a wrap paper for the consumable, and can retain its whiteness permanently. By including a large amount of such a loading material, the ISO whiteness of the wrap paper can be set equal to or greater than 83%, for example. Also, from a practical perspective of use as a wrap paper for the consumable, the first wrap paper and the second wrap paper preferably have a tensile strength equal to or greater than 8 N/15 mm. With this configuration, the wrap paper ruptures less easily, even when pulling out the consumable held in the holding unit. The tensile strength can be raised by reducing the loading material content. Specifically, the tensile strength can be raised by reducing the loading material content below the upper limit on the loading material content indicated in the basis weight ranges indicated as an example above.

The holding unit includes a first holding unit, and the chamber includes a second holding unit positioned farther away from the opening than the first holding unit. In the state in which the consumable is held by the first and second holding units of the chamber, the second holding unit is configured to compress the consumable more than the first holding unit, and/or the internal cross-sectional area of the second holding unit is smaller than the internal cross-sectional area of the first holding unit in the plane orthogonal to the longitudinal direction of the chamber. With this configuration, the draw resistance during smoking can be adjusted by the pressing of the second holding unit. Since the second holding unit is provided separately from the first holding unit, the shape of the second holding unit can be configured into a shape that achieves the desired draw resistance, independently from the shape of the first holding unit which is suited for optimal heating. The heating unit does not have to be disposed on the outer surface of the second pressing unit. In particular, by not disposing the heating unit on the second holding unit in the case where the portion of the consumable that is pressed by the second holding unit, such as the lid described above, does not include the smokable substance, heating that does not efficiently contribute to the heating of the smokable substance may be suppressed, and energy may be used efficiently.

The first holding unit may include a first pressing unit, which presses a part of the consumable, and a first non-pressing unit. The second holding unit may include a second pressing unit, which presses a part of the consumable, and a second non-pressing unit. By having the first holding unit include the first pressing unit, the consumable is substantially close to the heating surface (the inner surface of the pressing unit) in the first holding unit, and therefore heat from the heating unit can be transferred to the consumable efficiently.

The chamber preferably has a second guide unit provided with a tapered surface that connects the inner surface of the first pressing unit to the inner surface of the second pressing unit. The second guide unit can be used to change the cross-sectional shape of the inner surface of the chamber continuously from the first pressing unit to the second pressing unit, thereby making it possible to insert the consumable into the chamber smoothly.

The first holding unit may have a pair of first pressing surfaces facing each other, and the second holding unit may have a pair of second pressing surfaces facing each other. The shortest distance between the second pressing surfaces is preferably less than the shortest distance between the first pressing surfaces. The second pressing surfaces may be flat surfaces. Herein, a flat surface includes a substantially flat surface. In the direction orthogonal to the longitudinal direction of the chamber, the pressing surfaces of the second holding unit in the case where the second pressing surfaces are flat surfaces may point in the same direction as the pressing surface of the chamber of the first holding unit. This arrangement makes it easy to manufacture the chamber and makes it even easier to insert the consumable.

The second holding unit may also be disposed at the end of the chamber. In particular, in the case where the smokable substance on the leading end of the consumable is pressed, by using the pressing by the second holding unit to compress and unify the smokable substance on the leading end of the consumable, it is possible to reduce situations in which the smokable substance falls out inside the chamber when taking the consumable out of the chamber after smoking.

According to a second aspect of the present invention, a smoking system including a consumable containing a smokable substance and a device that heats and atomizes the smokable substance is provided. The device includes a chamber that receives the consumable and a heating unit that heats the consumable received into the chamber. The inner circumferential length of the chamber is the same as the outer circumferential length of the consumable before being received into the chamber, and the inner circumferential shape of the chamber in the plane orthogonal to the longitudinal direction of the chamber is different from the cross-sectional shape orthogonal to the longitudinal direction of the consumable before the consumable is received into the chamber. Herein, "the same" includes the case of being substantially the same. "Substantially the same" refers to a state in which the difference between the inner circumferential length of the chamber and the outer circumferential length of the consumable before being received into the chamber is within ±6% of the inner circumferential length of the chamber for example, preferably within ±4%, more preferably within ±2%.

According to the second aspect, the consumable is substantially close to the heating surface (the inner surface of the chamber), and therefore heat from the heating unit can be transferred to the consumable efficiently. Specifically, since the inner circumferential length of the chamber and the outer circumferential length of the consumable are substantially the same and the inner circumferential shape of the chamber is different from the cross-sectional shape of the consumable to be received into the chamber, a part of the consumable is pressed by the inner surface of the chamber, and the outer circumferential shape of the consumable approximately matches the inner circumferential shape of the inner surface of the holding unit. Compared to the case where the inner circumferential length and inner circumferential shape of the chamber are the same as the outer circumferential length and cross-sectional shape of the consumable, in this smoking system, a location is formed where the consumable is pressed by the chamber, and therefore the efficiency of heat transfer from the heating unit to the consumable may be improved. Also, compared to the case where the outer circumferential length of the consumable is shorter than the inner circumferential length of the chamber, the inner circumferential surface (non-pressing surface) of the chamber substantially touches the outer circumferential surface of the consumable even in the locations where the consumable is not being pressed, and therefore the efficiency of heat transfer from the heating unit to the consumable may be improved. Furthermore, compared to the case where the outer circumferential length of the consumable is longer than the inner circumferential length of the chamber, the consumable can be inserted into the chamber smoothly, and strain caused by the outer circumferential surface of the consumable and the density inside the consumable (for instance, tobacco as one example of a smokable substance) can be suppressed. As a result, it is possible to suppress uneven heating and inconsistencies in the draw resistance through each consumable, which may occur due to strain caused by the density inside the consumable. Also, it may be said that, preferably, the inner circumferential length of the chamber is substantially the same as the outer circumferential length of the consumable in the state of being pressed by the chamber, and the inner circumferential length of the chamber may be taken to be the inner circumferential length in the plane orthogonal to the longitudinal direction of the chamber. Also, the "outer circumferential length of the consumable before being received into the chamber" may be taken to be the outer circumferential length of the portion of the outer circumferential length of the consumable before being received into the chamber that is located at a position corresponding to the inner circumferential length of the chamber being compared to in the longitudinal direction of the chamber when the consumable is received into the chamber. Also, the "outer circumferential length of the consumable in the state of being pressed by the chamber" may be taken to be the outer circumferential length of the portion of the outer circumferential length of the consumable in the state of being pressed by the chamber that is located at a position corresponding to the inner circumferential length of the chamber being compared to in the longitudinal direction of the chamber.

Note that the features of another aspect may be combined with or applied to the second aspect, insofar as the action and effect of the second aspect are not impaired. Moreover, the chamber of the second aspect may also include a holding unit according to another aspect.

According to a third aspect of the present invention, a smoking system including a consumable containing a smokable substance and a device that heats and atomizes the smokable substance is provided. The device includes a chamber that receives the consumable. The chamber includes an opening through which the consumable is inserted and a holding unit that holds the consumable. The holding unit includes a pressing unit that presses a part of the consumable. The device includes an induction coil that heats at least the pressing unit. The pressing unit includes a susceptor that is heated by the induction coil.

According to the third aspect, the consumable is pressed by the heating surface (the inner surface of the pressing unit)

while the pressing unit that presses the consumable is heated by the induction coil, and therefore heat from the pressing unit can be transferred to the consumable efficiently. The susceptor may be disposed on or covered by the outer or inner surface of the pressing unit, the susceptor may be included in the walls of the chamber forming the pressing unit, or the walls of the chamber forming the pressing unit may be configured as the susceptor.

The induction coil may be configured using a single wire, but from the perspective of effective heat generation, may also be a litz wire in a screw shape. The single wire or litz wire preferably includes a material selected from at least one of the group consisting of copper, aluminum, nickel, silver, gold, and alloys thereof such as stainless steel, for example. The sheath material of the litz wire may be polyimide or polyester, for example.

The induction coil may be wound in a helical (three-dimensional screw) or a spiral (two-dimensional screw) shape. The shape of the induction coil may be cylindrical (obtained by bending a helical coil or a spiral coil) or flat. The induction coil may be adjacent to the chamber, may surround the chamber, or may project into the chamber interior, but by disposing the induction coil so as to surround the chamber, energy can be supplied to the pressing unit of the chamber efficiently. There may be a single induction coil or a plurality of induction coils. As an example of a configuration that surrounds the chamber, the induction coil may be configured in a helical shape so as to surround the chamber, may be configured such that a spiral coil is curved so as to surround the chamber, or may be configured to include a plurality of flat coils that surround the chamber, but by configuring the induction coil in a helical shape so as to surround the chamber, costs can be lowered with a simple configuration.

The frequency applied to the induction coil may be approximately equal to or greater than 80 kHz and less than or equal to 500 kHz, preferably approximately equal to or greater than 150 kHz and less than or equal to 250 kHz, more preferably equal to or greater than 190 kHz and less than or equal to 210 kHz. Alternatively, the frequency applied to the induction coil may be equal to or greater than 1 MHz and less than or equal to 30 MHz, preferably equal to or greater than 2 MHz and less than or equal to 10 MHz, more preferably equal to or greater than 5 MHz and less than or equal to 7 MHz. These frequencies may be determined with consideration for properties such as the material and the shape of the susceptor.

The device may also be disposed so to operate in a fluctuating electromagnetic field having a maximum magnetic flux density approximately equal to or greater than 0.5 tesla (T) and less than or equal to 2.0 tesla (T).

The term "susceptor" in this specification means a material that can convert electromagnetic energy into heat, and refers to a material for the purpose of heating the "smokable substance". The susceptor is disposed at a position where heat can be transferred to the "smokable substance". When the susceptor is positioned inside a fluctuating electromagnetic field, eddy currents induced in the susceptor and magnetic hysteresis loss inside the susceptor cause the susceptor to heat up.

The susceptor preferably includes a material selected from at least one of the group consisting of aluminum, iron, nickel, and alloys thereof (for example, nichrome and stainless steel). The susceptor and the paths of current flowing through the susceptor preferably include loops surrounding the space that houses the consumable. With this arrangement, eddy currents can be generated efficiently in the heat-generating portion of the chamber.

The susceptor may have any shape, and may be granular, rod-like, strip-shaped, annular, or tubular, for example. If the susceptor has looping electrical paths, eddy currents can be generated efficiently. A plurality of susceptors having the same shape may be arranged, or a plurality of susceptors having different shapes may be arranged.

Note that the features of another aspect may be combined with or applied to the third aspect, insofar as the action and effect of the third aspect are not impaired.

According to a fourth aspect of the present invention, a device that heats and atomizes a smokable substance is provided. The device includes a chamber that receives the consumable and a heating unit that heats the consumable received into the chamber. The chamber includes an opening through which the consumable is inserted and a holding unit that holds the consumable. The holding unit includes a pressing unit, which presses a part of the consumable, and a non-pressing unit. The pressing unit and the non-pressing unit each have an inner surface and an outer surface. The heating unit is disposed on the outer surface of the pressing unit.

According to the fourth aspect, the consumable is substantially close to the heating surface (the inner surface of the pressing unit), and therefore heat from the heating unit can be transferred to the consumable efficiently.

Disposing the heating unit on the outer surface of the pressing unit as described above is merely one example of a configuration by which heat is transferred to the consumable efficiently through the chamber by causing the consumable to be substantially close to the heating surface of the chamber. In the fourth aspect, a device that heats and atomizes a smokable substance is provided, in which the device may include a chamber that receives the consumable and a heating unit that heats the consumable received into the chamber, the chamber may include an opening through which the consumable is inserted and a holding unit that holds the consumable, the holding unit may include a pressing unit, which presses a part of the consumable, and a non-pressing unit, the pressing and non-pressing units may each have inner and outer surfaces, and the consumable may be heated through the pressing unit. Furthermore, the heating unit is not particularly limited but may be a heating unit disposed on the outer surface of the pressing unit as described above, or a susceptor may be included in the pressing unit and the pressing unit may be heated through an electromagnetic field and/or lines of magnetic force generated by an induction coil or the like as described above.

The heating unit preferably is disposed on the outer surface of the pressing unit with no gap. Here, no gap is also taken to mean that there is substantially no gap. With this arrangement, the consumable is substantially close to the heating surface (the inner surface of the pressing unit), and therefore heat from the heating unit can be transferred to the consumable even more efficiently. Note that the heating unit may also include an adhesive layer. In this case, the heating unit including the adhesive layer is preferably disposed with no gap to the outer surface of the pressing unit.

The inner surfaces of the pressing units preferably have pairs of flat pressing surfaces having a planar shape and facing each other, the inner surfaces of the non-pressing units preferably have pairs of curved non-pressing surfaces having a curved shape and facing each other that connect the ends of the pairs of flat pressing surfaces, and more preferably, the thickness of the pressing units and the non-pressing units is uniform (which also includes the case of being substantially uniform) and the same (which also includes the case of being substantially the same). Accordingly, the structure of the chamber is simplified and precision manufacturing is easy, and the positions of the pressing units and non-pressing units can be arranged in a balanced way to achieve uniform heating, making it easier to dispose the heating unit on the outer surface of the pressing unit with good positional accuracy and also without a gap, thereby raising the heating efficiency.

Note that the features of another aspect may be combined with or applied to the fourth aspect, insofar as the action and effect of the fourth aspect are not impaired.

According to a fifth aspect of the present invention, a consumable used in any of the above smoking systems is provided. The consumable includes a first portion pressed by the pressing unit of the chamber, a mouthpiece, and a second portion positioned between the first portion and the mouthpiece.

Note that the features of another aspect may be combined with or applied to the fifth aspect, insofar as the action and effect of the fifth aspect are not impaired.

According to a sixth aspect of the present invention, a device that heats and atomizes a smokable substance provided in a consumable is provided. The device includes a chamber that receives the consumable. The chamber includes an opening through which the consumable is inserted and a holding unit that holds the consumable. The holding unit includes a pressing unit that presses a part of the consumable. The device includes an induction coil that heats at least the pressing unit. The pressing unit includes a susceptor that is heated by the induction coil.

Note that the features of another aspect may be combined with or applied to the sixth aspect, insofar as the action and effect of the sixth aspect are not impaired.

According to a seventh aspect of the present invention, a device that heats and atomizes a smokable substance is provided. The device includes a chamber that receives the consumable, a heating unit that heats the consumable received into the chamber, and a tubular sleeve that surrounds the chamber. The chamber includes an opening through which the consumable is inserted and a holding unit that holds the consumable. The holding unit includes a pressing unit, which presses a part of the consumable, and a non-pressing unit. The pressing unit and the non-pressing unit each have an inner surface and an outer surface. The holding unit is provided with an air gap between the inner surface of the non-pressing unit and the consumable when the consumable is positioned at a desired position in the chamber, the air gap connecting the opening in the chamber and the end surface of the consumable positioned at the desired position in the chamber, or the opening in the chamber and the end surface of the consumable positioned inside the chamber and away from the opening in the chamber. Provided that, in the direction orthogonal to the longitudinal direction of the chamber, L1 is the shortest distance between the inner surface of the sleeve and the outer surface of the pressing unit and L2 is the shortest distance between the inner surface of the sleeve and the outer surface of the non-pressing unit of the chamber, L1 is greater than L2.

According to the seventh aspect, by making the distance between the inner surface of the sleeve and the outer surface of the pressing unit that presses a part of the consumable longer compared to the non-pressing unit, the length of the air layer in the gap is extended. As a result, when the consumable is heated at the pressing unit, the heat-insulating efficiency of the air layer between the pressing unit and the sleeve can be improved. The sleeve preferably includes a heat-insulating unit. In this case, the chamber can be surrounded by the heat-insulating unit, and therefore the transfer of heat from the heated consumable to the outside of the device may be suppressed.

Note that the features of another aspect may be combined with or applied to the seventh aspect, insofar as the action and effect of the seventh aspect are not impaired.

According to an eighth aspect of the present invention, a device is provided. The device includes a chamber that receives the consumable and a heating unit that heats the consumable received into the chamber. The chamber includes an opening through which the consumable is inserted and a holding unit that holds the consumable. The holding unit includes a pressing unit, which presses a part of the consumable, and a non-pressing unit. The pressing unit and the non-pressing unit each have an inner surface and an outer surface. The inner circumferential length of the holding unit is the same as the outer circumferential length of the consumable before being pressed by the pressing unit or the outer circumferential length of the consumable in the state after being pressed by the pressing unit.

In the case where the inner circumferential length of the holding unit and the outer circumferential length of the consumable are substantially the same, a part of the consumable is pressed by the pressing unit, thereby causing the outer circumferential shape of the consumable to approximately match the inner cross-sectional shape of the holding unit. Compared to the case where the inner circumferential length and inner circumferential shape of the holding unit are the same as the outer circumferential length and outer circumferential shape of the consumable, in this smoking system, a location is formed where the consumable is pressed by the pressing unit, and therefore the efficiency of heat transfer from the heating unit to the consumable may be improved. Also, compared to the case where the outer circumferential length of the consumable is shorter than the inner circumferential length of the holding unit, the inner circumferential surface (non-pressing surface) of the holding unit substantially touches the outer circumferential surface of the consumable even in the locations where the consumable is not being pressed, and therefore the efficiency of heat transfer from the heating unit to the consumable may be improved. Furthermore, compared to the case where the outer circumferential length of the consumable is longer than the inner circumferential length of the holding unit, the consumable can be inserted into the holding unit smoothly, and strain caused by the outer circumferential surface of the consumable and the density inside the consumable (for instance, tobacco as one example of a smokable substance) can be suppressed. As a result, it is possible to suppress uneven heating and inconsistencies in the draw resistance through each consumable, which may occur due to strain caused by the density inside the consumable.

Note that the features of another aspect may be combined with or applied to the eighth aspect, insofar as the action and effect of the eighth aspect are not impaired.

According to a ninth aspect of the present invention, a smoking system including a consumable containing a smokable substance and a device that heats and atomizes the smokable substance is provided. The device includes a chamber that receives the consumable and a heating unit that heats the consumable received into the chamber. The chamber includes an opening through which the consumable is inserted and a holding unit that holds the consumable. The holding unit includes a pressing unit, which presses a part of the consumable, and a non-pressing unit. The pressing unit and the non-pressing unit each have an inner surface and an outer surface. The inner circumferential length of the holding unit is the same as the outer circumferential length of the consumable before being pressed by the pressing unit or the outer circumferential length of the consumable after being pressed by the pressing unit.

In the case where the inner circumferential length of the holding unit and the outer circumferential length of the consumable are substantially the same, a part of the consumable is pressed by the pressing unit, thereby causing the outer circumferential shape of the consumable to approximately match the inner cross-sectional shape of the holding unit. Compared to the case where the inner circumferential length and inner circumferential shape of the holding unit are the same as the outer circumferential length and outer circumferential shape of the consumable, in this smoking system, a location is formed where the consumable is pressed by the pressing unit, and therefore the efficiency of heat transfer from the heating unit to the consumable may be improved. Also, compared to the case where the outer circumferential length of the consumable is shorter than the inner circumferential length of the holding unit, the inner circumferential surface (non-pressing surface) of the holding unit substantially touches the outer circumferential surface of the consumable even in the locations where the consumable is not being pressed, and therefore the efficiency of heat transfer from the heating unit to the consumable may be improved. Furthermore, compared to the case where the outer circumferential length of the consumable is longer than the inner circumferential length of the holding unit, the consumable can be inserted into the holding unit smoothly, and strain caused by the outer circumferential surface of the consumable and the density inside the consumable (for instance, tobacco as one example of a smokable substance) can be suppressed. As a result, it is possible to suppress uneven heating and inconsistencies in the draw resistance through each consumable, which may occur due to strain caused by the density inside the consumable.

Note that the features of another aspect may be combined with or applied to the ninth aspect, insofar as the action and effect of the ninth aspect are not impaired.

According to a 10th aspect of the present invention, a smoking system including a consumable containing a smokable substance and a device that heats and atomizes the smokable substance is provided. The device includes a chamber that receives the consumable and a heating unit that heats the consumable received into the chamber, and the chamber includes an opening through which the consumable is inserted and a holding unit that holds the consumable. The holding unit includes a pressing unit, which presses a part of the consumable, and a non-pressing unit. The pressing unit and the non-pressing unit each have an inner surface and an outer surface. The consumable includes a first portion having a first hardness and a second portion having a second hardness, in which the second portion is a different portion from the first portion in the insertion direction of the consumable. When the consumable is positioned at the desired position in the chamber, the consumable is positioned such that at least a part of the first portion is pressed against the inner surface of the pressing unit, while at the same time, at least a part of the second portion is pressed against the inner surface of the pressing unit.

According to the 10th aspect, in the case where the smokable substance is included in the first portion, efficient heating of the smokable substance and firm holding of the consumable may be achieved by the pressing unit at the same time. Note that the features of another aspect may be combined with or applied to the 10th aspect, insofar as the action and effect of the 10th aspect are not impaired.

According to an 11th aspect of the present invention, a device that heats and atomizes a smokable substance is provided. The device includes a chamber that receives the consumable and a heating unit that heats the consumable received into the chamber. The chamber includes a holding unit that holds the consumable. The holding unit includes a pressing unit that presses a part of the consumable. The pressing unit has an inner surface and an outer surface. The heating unit is disposed on the outer surface of the pressing unit. The outer surface of the pressing unit is a flat surface.

According to the 11th aspect, the consumable is substantially close to the heating surface (the inner surface of the pressing unit), and therefore heat from the heating unit can be transferred to the consumable efficiently. Also, since the outer surface of the pressing unit is a flat surface, when band-shaped electrodes are connected to the heating unit disposed on the outer surface of the pressing unit, bending of the band-shaped electrodes can be suppressed, thereby making it easier to lay out electrodes inside the device. In addition, compared to the case where the outer surface of the pressing unit is a curved or uneven surface, the heating unit can be positioned accurately and disposed easily without a gap to the outer surface of the pressing unit.

Note that the features of another aspect may be combined with or applied to the 11th aspect, insofar as the action and effect of the 11th aspect are not impaired.

REFERENCE SIGNS LIST

40: heating unit
40*a*: first portion
40*b*: second portion
42: heating element
44: electrical insulation member
46: induction coil
48: electrode
50: chamber
52: opening
54: non-holding unit
58: first guide unit
58*a*: tapered surface
60: holding unit
62: pressing unit
62*a*: inner surface
62*b*: outer surface
63: susceptor
66: non-pressing unit
66*a*: inner surface
66*b*: outer surface
67: air gap
70: first holding unit
72*a*: inner surface
72*b*: outer surface
73*a*: inner surface
73*b*: outer surface
76: second holding unit
77*a*: inner surface
77*b*: outer surface
78*a*: inner surface
78*b*: outer surface
79*a*: tapered surface
100: smoking system
110: consumable

111: smokable substance
120: device
S1: first portion
S2: second portion

The invention claimed is:

1. A smoking system including comprising:

a consumable containing a smokable substance and a device that includes a chamber receiving the consumable and heats and atomizes the smokable substance of the consumable received in the chamber, wherein the chamber includes an opening through which the consumable is inserted and a holding unit that holds the consumable, wherein the holding unit includes a first pressing unit which presses a part of the consumable, wherein the consumable includes a first portion having a first hardness and a second portion having a second hardness, in which the second portion is a different portion from the first portion in the insertion direction of the consumable, and wherein when the consumable is positioned at the desired position in the chamber, the consumable is positioned such that at least a part of the first portion is pressed against the first pressing unit, while at the same time, at least a part of the second portion is pressed against the first pressing unit, wherein the second hardness is different from the first hardness, wherein the first portion includes the smokable substance containing tobacco, wherein the second portion includes a cylindrical member, and wherein the cylindrical member is a paper tube or a hollow filter.

2. The smoking system according to claim 1, wherein the first hardness is equal to or greater than 65% and less than or equal to 90%.

3. The smoking system according to claim 1, wherein the second hardness is equal to or greater than 90% and less than or equal to 99%.

4. The smoking system according to claim 1, wherein the second hardness is higher than the first hardness.

5. The smoking system according to claim 1, wherein the first portion and the second portion are disposed adjacently.

6. The smoking system according to claim 1, wherein the difference between the first hardness and the second hardness is at least equal to or greater than 4%.

7. The smoking system according to claim 1, wherein the distance over which the second portion of the consumable is inserted into the holding unit when the consumable is positioned at the desired position is equal to or greater than 1.0 mm and less than or equal to 10.0 mm.

8. The smoking system according to claim 1, wherein the opening can receive the consumable without pressing.

9. The smoking system according to claim 1, wherein the chamber has a first guide unit provided with a tapered surface that connects the inner surface of the chamber forming the opening to the inner surface of the first pressing unit.

10. The smoking system according to claim 1, wherein the chamber includes a second pressing unit, and the second pressing unit is positioned farther away from the opening than the first pressing unit.

11. The smoking system according to claim 10, wherein the second pressing unit is disposed at the end of the chamber.

12. The smoking system according to claim 10, wherein the holding unit includes a first holding unit and a second holding unit positioned farther away from the opening than the first holding unit, the first holding unit includes the first pressing unit, the second holding unit includes the second pressing unit, and the second pressing unit is configured to compress the consumable more than the first pressing unit, and/or the internal cross-sectional area of the second holding unit is smaller than the internal cross-sectional area of the first holding unit in the plane orthogonal to the longitudinal direction of the chamber.

13. The smoking system according to claim 1, wherein the first pressing unit has an inner surface, and the inner surface is a flat surface.

14. The smoking system according to claim 1, wherein the first pressing unit is of a uniform thickness.

15. The smoking system according to claim 1, wherein the chamber includes two or more first pressing units in a circumferential direction of the chamber.

16. The smoking system according to claim 1, wherein the chamber includes an abutting unit abutted by the consumable inserted into the chamber, on the inside of the chamber, the abutting unit supports a part of the consumable such that at least a part of the end surface of the consumable is exposed.

17. The smoking system according to claim 1, wherein the holding unit includes a non-pressing unit, the non-pressing unit having an inner surface, and an air gap is provided between the inner surface of the non-pressing unit and the consumable when the consumable is positioned at a desired position in the chamber, the air gap connecting the opening in the chamber and the end surface of the consumable positioned at the desired position in the chamber, or the opening in the chamber and the end surface of the consumable positioned inside the chamber and away from the opening in the chamber.

18. A method for holding a consumable used for a smoking system and including a first portion having a first hardness and a second portion having a second hardness, in which the second portion is a different portion from the first portion in the insertion direction of the consumable, comprising:

inserting the consumable into a chamber through an opening to position the consumable at the desired position in the chamber, and pressing a part of the consumable with a first pressing unit of the chamber and a part of the consumable with a second pressing unit of the chamber, when the consumable is positioned at the desired position in the chamber, wherein the second hardness is different from the first hardness, wherein the first portion includes the smokable substance containing tobacco, wherein the second portion includes a cylindrical member, and wherein the cylindrical member is a paper tube or a hollow filter.

* * * * *